US009487283B2

(12) United States Patent
Inoue et al.

(10) Patent No.: US 9,487,283 B2
(45) Date of Patent: Nov. 8, 2016

(54) VESSEL PROPULSION SYSTEM AND VESSEL HAVING THE SAME

(71) Applicant: YAMAHA HATSUDOKI KABUSHIKI KAISHA, Iwata-shi, Shizuoka (JP)

(72) Inventors: Hiroshi Inoue, Shizuoka (JP); Makoto Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 221 days.

(21) Appl. No.: 14/460,454

(22) Filed: Aug. 15, 2014

(65) Prior Publication Data

US 2015/0166159 A1 Jun. 18, 2015

(30) Foreign Application Priority Data

Dec. 16, 2013 (JP) ..... 2013-259486

(51) Int. Cl.

| | |
|---|---|
| ***B63H 25/00*** | (2006.01) |
| ***B63H 20/12*** | (2006.01) |
| ***B63H 20/10*** | (2006.01) |
| ***B63H 20/16*** | (2006.01) |
| ***B63H 11/00*** | (2006.01) |
| *B63H 20/00* | (2006.01) |
| *B63H 25/02* | (2006.01) |

(52) U.S. Cl.

CPC ..... *B63H 20/12* (2013.01); *B63H 11/00* (2013.01); *B63H 20/10* (2013.01); *B63H 20/16* (2013.01); *B63H 2020/003* (2013.01); *B63H 2025/026* (2013.01)

(58) Field of Classification Search

CPC ..... B63H 2025/026; B63H 2020/003; B63H 25/42

See application file for complete search history.

(56) References Cited

U.S. PATENT DOCUMENTS

| | | | | |
|---|---|---|---|---|
| 6,994,046 | B2 * | 2/2006 | Kaji | B63H 25/42 114/144 R |
| 7,267,068 | B2 * | 9/2007 | Bradley | B63H 25/42 114/144 A |
| 8,589,004 | B1 * | 11/2013 | Kanno | B63H 25/42 440/4 |
| 2007/0089660 | A1 | 4/2007 | Bradley et al. | |
| 2009/0004930 | A1 | 1/2009 | Larsson | |

* cited by examiner

*Primary Examiner* — Edwin Swinehart

(74) *Attorney, Agent, or Firm* — Keating and Bennett, LLP

(57) ABSTRACT

A vessel propulsion system includes two propulsion devices that are disposed on a left side and on a right side, respectively, with respect to a central line extending in a front-rear direction through a rotational center of a hull, an operating device that outputs a lateral movement command including a commanded direction, and a controller. The controller is configured and programmed to control the thrust and the steering angle of each of the two propulsion devices so that, when the operating device outputs a lateral movement command, a first propulsion device on a side existing in the commanded direction generates a backward thrust, whereas a second propulsion device generates a forward thrust, and so that an operating point of a resultant force of the thrusts of the two propulsion devices is positioned to deviate to the side in the commanded direction from the central line, and so that a direction of action of the resultant force follows the commanded direction.

20 Claims, 9 Drawing Sheets

1
2
3L
3R
50
53L
53R
55
56
F
TL
TR 1
2
3L
3R
50
53L
53R
55
56
57
F
TL
TR 1
2
3L
3R
50
53L
53R
55
56
57
F
TL
TR

VESSEL PROPULSION SYSTEM AND VESSEL HAVING THE SAME

BACKGROUND OF THE INVENTION

1. Field of the Invention

The present invention relates to a vessel propulsion system and a vessel including such a system.

2. Description of the Related Art

US 2007/0089660A1 discloses an arrangement in which a thrust vector of a first propulsion device and a thrust vector of a second propulsion device are both aligned with lines respectively passing through the center of gravity of a vessel, thus moving the vessel in a lateral direction without turning the vessel.

US 2009/0004930A1 teaches that the center of rotation of a watercraft traveling at a low speed substantially coincides with the center of gravity of the watercraft whereas the center of rotation of the watercraft traveling at a high speed is influenced by the center of pressure. The center of pressure denotes a point on which a force received by the watercraft from the water is regarded as acting. In US 2009/0004930A1, the position on which a pair of right and left thrusts is applied on the water craft is displaced towards the center of pressure from the center of gravity in accordance with an increase in the speed of the watercraft, thus achieving a sideways movement of the watercraft.

SUMMARY OF THE INVENTION

The inventor of preferred embodiments of the present invention described and claimed in the present application conducted an extensive study and research regarding a vessel propulsion system, such as the one described above, and in doing so, discovered and first recognized new unique challenges and previously unrecognized possibilities for improvements as described in greater detail below.

In the arrangements of US 2007/0089660A1 and US 2009/0004930A1, the resultant force of thrusts of two propulsion devices has an operating point on a hull center line. The hull center line denotes a line that extends in a front-rear direction through the center of gravity of a hull. The two propulsion devices are arranged symmetrically with respect to the hull center line. One of the two propulsion devices generates a thrust in a forward direction, and the other propulsion device generates a thrust in a backward direction. These thrusts are controlled to be equal in magnitude to each other. As a result, the hull is configured to be moved either rightwardly or leftwardly in the lateral direction.

However, the maximum thrust in the forward direction and the maximum thrust in the backward direction may be different in some cases, depending on the type of the propulsion device. More specifically, in an outboard motor and in an inboard-outboard motor, the maximum thrust in the backward direction is smaller than the maximum thrust in the forward direction. This results from the fact that, in an outboard motor and in an inboard-outboard motor, the steering angle is limited to less than 360 degrees (more specifically, less than 180 degrees), and therefore a propeller is required to be rotationally driven in opposite directions when forwardly traveling and when backwardly traveling. The steering angle denotes an angle of a thrust generated by the propulsion device with respect to the hull center line. In an outboard motor, the turnable angle thereof with respect to a stern is limited. In an inboard-outboard motor, the turnable angle of a drive unit with respect to a hull is limited. In general, the blade shape of a propeller is designed so as to efficiently generate a thrust during forward rotation, and therefore a comparatively small thrust is generated during backward rotation even if the rotation speed is the same as during forward rotation.

In the conventional techniques of US 2007/0089660A1 and US 2009/0004930A1, in order to move the vessel in the lateral direction, it is necessary to equalize the magnitude of the thrust in the forward direction generated by one of the propulsion devices with the magnitude of the thrust in the backward direction generated by the other propulsion device. Therefore, when the maximum backward thrust is generated from the propulsion device that is backwardly driven, the propulsion device that is forwardly driven is required to restrain its output so as to generate a forward thrust that is the same in magnitude as the maximum backward thrust. Therefore, the magnitude of a resultant force during a lateral movement is limited by the maximum backward thrust in spite of the fact that the forwardly driven propulsion device has a reserve force.

A preferred embodiment of the present invention provides a vessel propulsion system including two propulsion devices that are disposed on a left side and on a right side, respectively, with respect to a central line extending in a front-rear direction through a rotational center of a hull and that are variable in thrust and in steering angle. The vessel propulsion system further includes an operating device that outputs a lateral movement command to cause the hull to make a lateral movement in a lateral direction perpendicular to the central line. The lateral movement command includes a commanded direction of either a rightward direction or a leftward direction in accordance with an operation performed by an operator. The vessel propulsion system further includes a controller configured and programmed to control the thrust and the steering angle of each of the two propulsion devices so that, when the operating device outputs a lateral movement command, one of the two propulsion devices that is disposed on a side of the commanded direction with respect to the central line generates a backward thrust, whereas a remaining one of the two propulsion devices that is disposed on a side of a direction opposite to the commanded direction with respect to the central line generates a forward thrust, and so that an operating point of a resultant force of the thrusts of the two propulsion devices is positioned to deviate to the side in the commanded direction from the central line, and so that a direction of action of the resultant force matches the commanded direction.

The lateral direction is a rightward direction or a leftward direction, and therefore, a lateral movement in the lateral direction denotes a movement in the leftward direction or a movement in the rightward direction. The operating point of a resultant force is a point of the hull on which the resultant force of the thrusts of the two propulsion devices is regarded as acting. The position of the operating point of the resultant force is an intersection of the lines of action of the thrusts generated by the two propulsion devices when viewed in plan. The operating point with respect to the hull of the thrust generated by each propulsion device is an attachment portion with respect to the hull of each propulsion device. The operating point of the resultant force is determined by the steering angles of the two propulsion devices. The forward thrust is a thrust that advances the hull, and the backward thrust is a thrust that moves the hull backwardly. It should be noted that the behavior of the hull depends on the resultant force of the thrusts generated by the propulsion devices. Therefore, the generation of a forward thrust by one propulsion device does not necessarily result in the advancement of the hull, and, likewise, the generation of a backward thrust by one propulsion device does not necessarily result in the backward movement of the hull.

According to the arrangement described above, the lateral movement of the hull is achieved by the thrusts of the two propulsion devices disposed on the left and right sides, respectively, with respect to the central line of the hull. When the operating device outputs a lateral movement command in response to the operation of an operator, one of the two propulsion devices disposed on the side in a commanded direction is controlled to generate a backward thrust, and the propulsion device disposed on the side in a direction opposite to the commanded direction is controlled to generate a forward thrust. On the other hand, the steering angles of the two propulsion devices are controlled so that the operating point of a resultant force of those thrusts is positioned to deviate to the side in the commanded direction from the hull central line. The thrusts and the steering angles of the two propulsion devices are controlled so that the direction of action of the resultant force matches the commanded direction. As a result, the hull makes a lateral movement in accordance with the command of the operator. The operating point of the resultant force of the thrusts of the two propulsion devices is not positioned on the central line, but is positioned to deviate to the commanded direction side from the central line. Therefore, a forward thrust generated by the propulsion device disposed on the side opposite to the commanded direction side is preferably set to be greater than a backward thrust generated by the propulsion device disposed on the commanded direction side, and, as a result, the direction of the resultant force becomes perpendicular to the hull central line. Therefore, a forward thrust greater than a backward thrust is used during a lateral movement, and therefore it is possible to make a lateral movement that effectively uses the forward thrust. As a result, it is possible to provide a vessel propulsion system improved in lateral movability. Particularly from the viewpoint of characteristics of the propulsion device, lateral movability is remarkably improved when the maximum forward thrust is greater than the maximum backward thrust.

In a preferred embodiment of the present invention, the controller is configured and programmed to control the steering angles of the two propulsion devices so that the operating point of the resultant force is positioned on a right-left direction line extending perpendicular to the central line through the rotation center in a right-left direction when the operating device outputs a lateral movement command. According to this arrangement, the operating point of the resultant force is disposed on the right-left direction line extending perpendicular to the central line through the rotational center of the hull. Therefore, the resultant force has an operating point on the right-left direction line, and acts along the right-left direction line, and hence does not provide a moment to the hull. As a result, the hull makes a lateral movement without turning round. Accordingly, it is possible to make a lateral movement that effectively uses a forward thrust, and therefore it is possible to increase the lateral movability of the vessel. The turning denotes the rotation of the hull around the rotational center.

In a preferred embodiment of the present invention, the controller is configured and programmed to control the steering angle of one of the propulsion devices that generates a backward thrust, i.e., the propulsion device disposed on the commanded direction side with respect to the central line, so that the thrust of the propulsion device follows a straight traveling direction. According to this arrangement, the propulsion device (i.e., the propulsion device disposed on the commanded direction side with respect to the central line) that generates a backward thrust generates a thrust along a straight traveling direction. Therefore, the backward thrust of this propulsion device does not substantially contribute to the lateral movement of the hull. A thrust component in the lateral direction is provided by the thrust of the propulsion device that generates a forward thrust, and the thrust component in the forward direction is countervailed by the backward thrust of the propulsion device disposed on the commanded direction side. As a result, the hull makes a lateral movement by making the forward thrust greater than the backward thrust, and therefore it is possible to make a lateral movement that effectively uses a forward thrust.

The straight traveling direction is the direction of a thrust generated by a propulsion device so as to cause the vessel to travel straight. Although the straight traveling direction is substantially parallel to the front-rear direction (i.e., substantially parallel to the central line), the straight traveling direction does not need to be completely parallel to the front-rear direction. In some cases, for example, the lines of action of the thrusts of the two propulsion devices intersect to make a so-called toe angle. In this case, the straight traveling direction may be a direction inclined by an angle corresponding to the toe angle with respect to the hull central line. Additionally, even in a case that the thrust action lines of the two propulsion devices make a toe angle, the straight traveling direction during a lateral movement may be set to be parallel to the front-rear direction of the vessel.

In a preferred embodiment of the present invention, the controller is configured and programmed to control the thrusts of the two propulsion devices so that, when the operating device outputs a lateral movement command, a thrust of the propulsion device that generates a forward thrust, i.e., the propulsion device disposed on a side opposite to the commanded direction side with respect to the central line, becomes greater than a thrust of the propulsion device that generates a backward thrust, i.e., the propulsion device disposed on the commanded direction side with respect to the central line. According to this arrangement, it is possible to effectively use a forward thrust during a lateral movement, and therefore it is possible to increase the lateral movability of the vessel.

In a preferred embodiment of the present invention, the operating device is configured to output a diagonal movement command to make a movement in a diagonal direction that obliquely intersects the central line, and the controller is configured and programmed to increase or decrease a thrust of the propulsion device that generates the forward thrust when, subsequent to the lateral movement command, the operating device outputs a diagonal movement command to make a movement in a diagonal direction including a component of a commanded direction of the lateral movement command, so that the hull moves in the diagonal direction according to the diagonal movement command.

According to this arrangement, when, subsequent to a lateral movement command, the operating device outputs a diagonal movement command to the same side as the lateral movement command, the hull is moved in the corresponding diagonal direction by increasing or decreasing the thrust of the propulsion device that generates a forward thrust. In other words, the movement of the hull in the diagonal direction is realized by adjusting the forward thrust. As a result, it is possible to achieve the diagonal movement of the hull without greatly changing the steering angle of the propulsion device.

The diagonal movement of the hull may be realized by steering the propulsion device that generates a backward thrust, instead of increasing or decreasing the forward thrust, or, alternatively, in addition to increasing or decreasing the forward thrust.

In a preferred embodiment of the present invention, when the diagonal movement command is a diagonally forward movement command, the controller is configured and programmed to increase a thrust of the propulsion device that generates the forward thrust, and, when the diagonal movement command is a diagonally backward movement command, the controller is configured and programmed to decrease a thrust of the propulsion device that generates the forward thrust.

According to this arrangement, it is possible to move the vessel diagonally forward by increasing the forward thrust, and it is possible to move the vessel diagonally backward by decreasing the forward thrust. As a result, it is possible to control the diagonal movement of the vessel by effectively using the forward thrust. Particularly from the viewpoint of characteristics of the propulsion device, in the case that the maximum forward thrust is greater than the maximum backward thrust, the adjustable range of the forward thrust is greater, and therefore it is possible to make a diagonal movement in a wide directional range.

In a preferred embodiment of the present invention, the controller is configured and programmed to control the steering angles of the two propulsion devices so that, when the diagonal movement command is a diagonally forward movement command, the operating point of the resultant force is positioned ahead of the rotational center and so that, when the diagonal movement command is a diagonally backward movement command, the operating point of the resultant force is positioned behind the rotational center.

According to this arrangement, the operating point of the resultant force is positioned ahead of the rotational center when the hull moves diagonally forward, whereas the operating point of the resultant force is positioned behind the rotational center when the hull moves diagonally backward. Therefore, it is easy to align the direction from the rotational center toward the operating point of the resultant force with the direction of the resultant force. As a result, it is possible to move the hull in the diagonal direction while restraining the turning of the hull.

In a preferred embodiment of the present invention, the controller is configured and programmed to control the steering angles and the thrusts of the two propulsion devices so that a half-line drawn so as to pass through the operating point of the resultant force from the rotational center coincides with the line of action of the resultant force. In other words, the controller is configured and programmed to control the steering angles and the thrusts of the two propulsion devices so that the line of action of the resultant force passes through the rotational center.

According to this arrangement, the half-line drawn from the rotational center toward the operating point of the resultant force coincides with the line of action of the resultant force, and therefore the resultant force does not provide a moment to the hull. As a result, it is possible to move the hull in the diagonal direction while restraining the turning of the hull.

In a preferred embodiment of the present invention, the operating device is configured to output a turning command to cause the hull to turn round, and, when the operating device outputs the turning command along with the lateral movement command, the controller is configured and programmed to change the steering angle of the propulsion device that generates the forward thrust, thus causing the hull to turn round.

According to this arrangement, the steering angle of the propulsion device generating a forward thrust is changed when a lateral movement command and a turning command are output from the operating device. As a result, the operating point of the resultant force moves, thus making it possible to provide a moment to the hull. As a result, the hull turns round while moving in a direction corresponding to the lateral movement command. Therefore, it is possible to control the hull behavior while effectively using a forward thrust.

In a preferred embodiment of the present invention, the controller is configured and programmed to control the steering angles of the two propulsion devices so that, when the operating device outputs the turning command along with the lateral movement command, the operating point of the resultant force is positioned to deviate in the front-rear direction of the vessel from the operating point of the resultant force during a lateral movement without turning round.

According to this arrangement, it is possible to cause the hull to turn round while making a lateral movement by deviating the operating point of the resultant force in the front-rear direction. More specifically, the turning of the hull during a lateral movement may be made by moving the operating point of the resultant force on a front-rear direction line (straight line parallel to the central line) passing through the operating point of the resultant force during the lateral movement without turning round.

A preferred embodiment of the present invention provides a vessel that includes a hull and the aforementioned vessel propulsion system including the aforementioned two propulsion devices attached to the hull.

The propulsion device is preferably a propulsion device configured to switch between generating a forward thrust and a backward thrust. For example, the propulsion device may be configured so as to generate a forward thrust by rotating a propeller in a forward rotational direction and so as to generate a backward thrust by rotating the propeller in a backward rotational direction. Additionally, the propulsion device may be configured so that the maximum forward thrust is greater than the maximum backward thrust. Still additionally, the propulsion device may be configured so that the steering range with respect to the hull is less than 360 degrees, and, more specifically, less than 180 degrees, and, even more specifically, less than 90 degrees. More specifically, the propulsion device may be an outboard motor, an inboard-outboard motor, an inboard motor, a waterjet propulsion device, etc.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 4 is a pictorial plan view to describe the disposition of the outboard motor and so on.

DETAILED DESCRIPTION OF THE PREFERRED EMBODIMENTS

Figure 1:
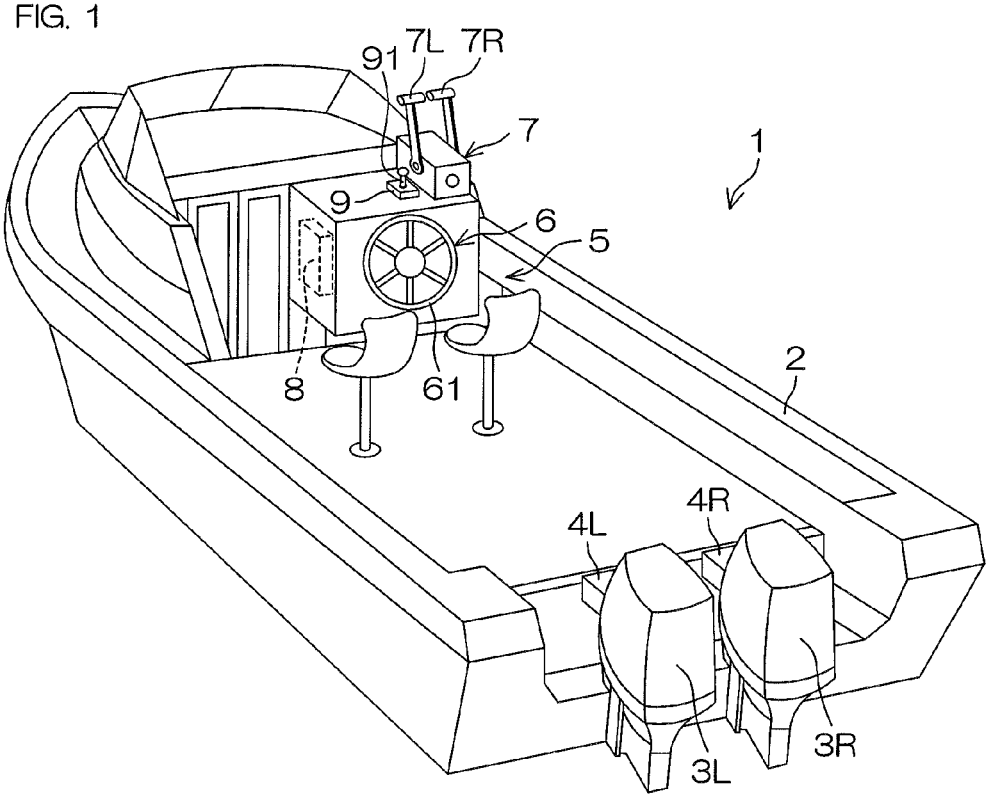
FIG. 1 is a perspective view of a vessel according to a preferred embodiment of the present invention.

FIG. 1 is a perspective view of a vessel 1 according to a preferred embodiment of the present invention. The vessel 1 may be a so-called small craft. A small craft denotes a vessel having a gross tonnage of less than 20 tons. It should be noted that, even if the vessel has a gross tonnage of 20 tons or more, a vessel whose length is less than 20 meters is included in the category of small crafts.

The vessel 1 includes a hull 2, a plurality of outboard motors 3L and 3R (in this preferred embodiment, preferably two outboard motors, for example), and a plurality of steering mechanisms 4L and 4R.

The outboard motors 3L and 3R are two propulsion devices that provide a thrust to the hull 2. The outboard motors 3L and 3R are arranged in a width direction of the hull 2 and are attached to the hull 2. The outboard motors include a portside outboard motor 3L disposed at the portside of the stern of the hull 2 and a starboard outboard motor 3R disposed at the starboard of the stern of the hull 2. Each of the outboard motors 3L and 3R is attached so as to be steerable in left and right directions. The steering mechanisms include a portside steering mechanism 4L that steers the portside outboard motor 3L rightwardly and leftwardly and a starboard steering mechanism 4R that steers the starboard outboard motor 3R rightwardly and leftwardly. When appropriate, the plurality of outboard motors 3L and 3R will be hereinafter referred to generically as the "outboard motor 3." Additionally, when appropriate, the plurality of steering mechanisms 4L and 4R will be hereinafter referred to generically as the "steering mechanism 4." The outboard motor 3 cannot freely make a 360-degree rotation for structural reasons, and is steerable rightwardly and leftwardly within a steerable range having a predetermined limitation. Specifically, the outboard motor 3 is attached to the hull 2 in a steerable state within a steerable range of about 60 degrees.

The hull 2 includes a vessel operation seat 5. The vessel operation seat 5 is provided with a steering operation device 6, a remote control device 7, a central controller 8, and a joystick device 9.

The steering operation device 6 is a device configured to allow a vessel operator to command the course of the vessel 1. More specifically, the steering operation device 6 includes a steering wheel 61 that is rotated rightwardly and leftwardly by the vessel operator. The outboard motor 3 is steered by rotating the steering wheel 61, thus making it possible to turn the vessel 1 rightwardly and leftwardly.

The remote control device 7 includes levers 7L and 7R operated by the vessel operator. Outputs of the outboard motors 3L and 3R are adjusted by operating the levers 7L and 7R, respectively, thus making it possible to adjust the speed of the vessel. Additionally, the direction of a thrust generated by the outboard motors 3L and 3R is switchable between the forward direction and the backward direction by operating the levers 7L and 7R.

The joystick device 9 includes a stick 91 that is operated by the vessel operator. The stick 91 is operated so as to be tilted forwardly, backwardly, leftwardly, and rightwardly, and so as to be rotated around an axis. As a result, a course command in the tilted direction of the stick 91 is generated, a thrust command corresponding to the tilt amount of the stick 91 is generated, and a turning command corresponding to the rotational direction and corresponding to the rotational amount of the stick 91 is generated. In this preferred embodiment, the stick 91 includes a spherical head portion which serves as a knob to ease the rotational operation on the stick 91.

The central controller 8 communicates with the outboard motor 3, the steering device 6, and the remote control device 7, and integrally controls these devices.

Figure 2:
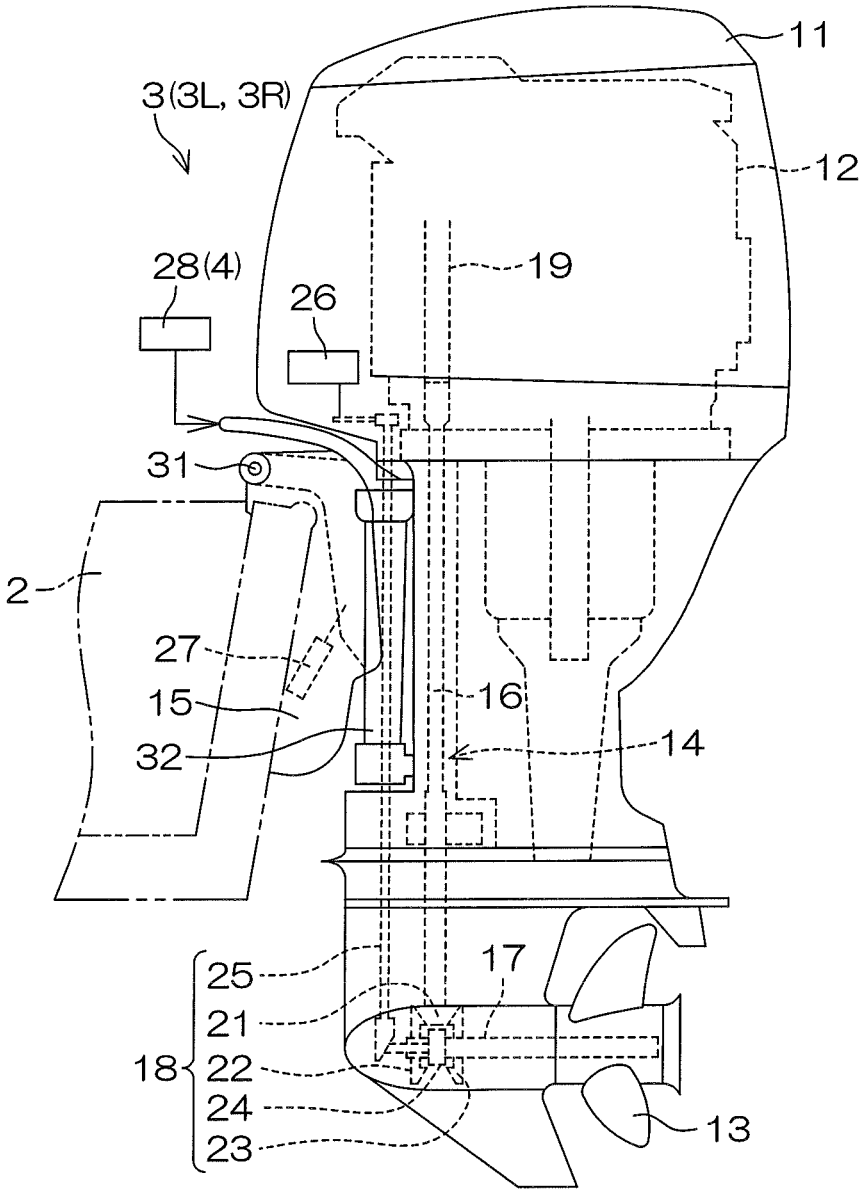
FIG. 2 is a pictorial side view to describe an arrangement of an outboard motor provided on the vessel.

FIG. 2 is a pictorial side view to describe an arrangement of the outboard motor 3. The outboard motor 3 includes a cover member 11, an engine 12, a propeller 13, a power transmission mechanism 14, and a bracket 15. The cover member 11 houses the engine 12 and the power transmission mechanism 14. The engine 12 is disposed in an upper space of the cover member 11. The engine 12 is one example of a power source to generate a thrust. The propeller 13 is rotationally driven by a driving force generated by the engine 12. The propeller 13 is disposed outside the cover member 11 in a lower portion of the outboard motor 3. The power transmission mechanism 14 transmits the driving force of the engine 12 to the propeller 13. The power transmission mechanism 14 includes a drive shaft 16, a propeller shaft 17, and a shift mechanism 18.

The drive shaft 16 is disposed along an up-down direction. The drive shaft 16 is connected to a crankshaft 19 of the engine 12, and transmits power generated by the engine 12. The propeller shaft 17 is disposed along a front-rear direction. The propeller shaft 17 is connected to the lower portion of the drive shaft 16 through the shift mechanism 18. The propeller shaft 17 transmits the driving force of the drive shaft 16 to the propeller 13.

The shift mechanism 18 switches the rotational direction of power transmitted from the drive shaft 16 to the propeller shaft 17. The shift mechanism 18 includes a pinion gear 21, a forward gear 22 for forward movement, a backward gear 23 for backward movement, and a dog clutch 24. The pinion gear 21 is fixed to the lower end of the drive shaft 16. The forward gear 22 and the backward gear 23 are disposed on the propeller shaft 17 so as to be relatively rotatable with respect to the propeller shaft 17. The pinion gear 21 engages with the forward gear 22 and the backward gear 23. The dog clutch 24 makes a spline connection to the propeller shaft 17, and is disposed between the forward gear 22 and the backward gear 23. The dog clutch 24 is movable along the propeller shaft 17, and rotates together with the propeller shaft 17. The dog clutch 24 is movable among a forward position, a neutral position, and a backward position on the propeller shaft 17. The forward position is a position at which the dog clutch 24 engages with the forward gear 22 and does not engage with the backward gear 23. The backward position is a position at which the dog clutch 24 engages with the backward gear 23 and does not engage with the forward gear 22. The neutral position is a position at which the dog clutch 24 engages neither with the forward gear 22 nor with the backward gear 23, and is located between the forward position and the backward position. When the dog clutch 24 is set at the forward position, the rotation of the drive shaft 16 is transmitted to the propeller shaft 17 through the forward gear 22. As a result, the propeller 13 rotates in a forward rotational direction in which a thrust that advances the hull 2 is generated. When the dog clutch 24 is set at the backward position, the rotation of the drive shaft 16 is transmitted to the propeller shaft 17 through the backward gear 23. As a result, the propeller 13 rotates in a backward rotational direction in which a thrust that backwardly moves the hull 2 is generated. When the dog clutch 24 is set at the neutral position, neither the rotation of the forward gear 22 nor the rotation of the backward gear 23 is transmitted to the propeller shaft 17. Therefore, the driving force is not transmitted to the propeller 13.

The shift mechanism 18 additionally includes a shift rod 25 by which the dog clutch 24 is moved along the propeller shaft 17. The shift rod 25 is driven by a shift actuator 26. Therefore, the dog clutch 24 is controlled to be set at any one of the forward position, the neutral position, and the backward position by controlling the operation of the shift actuator 26. Hereinafter, the position of the dog clutch 24 is referred to also as the "shift position" when appropriate.

The bracket 15 is a mechanism to attach the outboard motor 3 to the hull 2. The outboard motor 3 is attached to the bracket 15 so as to be rotatable around a tilt shaft 31 and a steering shaft 32. The tilt shaft 31 extends in the width direction (the horizontal direction) of the hull 2. The steering shaft 32 is perpendicular to the tilt shaft 31, and is arranged substantially along the up-down direction in a state in which the outboard motor 3 is being used. A tilt trim actuator 27 is provided to rotate the outboard motor 3 around the tilt shaft 31. The trim angle of the outboard motor 3 is varied by rotating the outboard motor 3 around the tilt shaft 31. The trim angle is a setting angle of the outboard motor 3 with respect to the hull 2.

The steering mechanism 4 is arranged to rotate the outboard motor 3 around the steering shaft 32. The steering mechanism 4 includes a steering actuator 28 serving as a power source. The steering angle is varied by causing the steering mechanism 4 to rotate the outboard motor 3 around the steering shaft 32. The steering angle is an angle of the direction of the thrust of the outboard motor 3 with respect to the front-rear direction of the hull 2.

The blade shape of the propeller 13 is designed to efficiently generate a thrust during rotation in the forward direction (during forward rotation). Therefore, a generated thrust is small during rotation in the backward direction (during backward rotation) even if the rotation speed is the same as during forward rotation. Therefore, in the outboard motor 3, the maximum thrust (the maximum forward thrust) when the shift position is set at the forward position is greater than the maximum thrust (the maximum backward thrust) when the shift position is set at the backward position.

Figure 3:
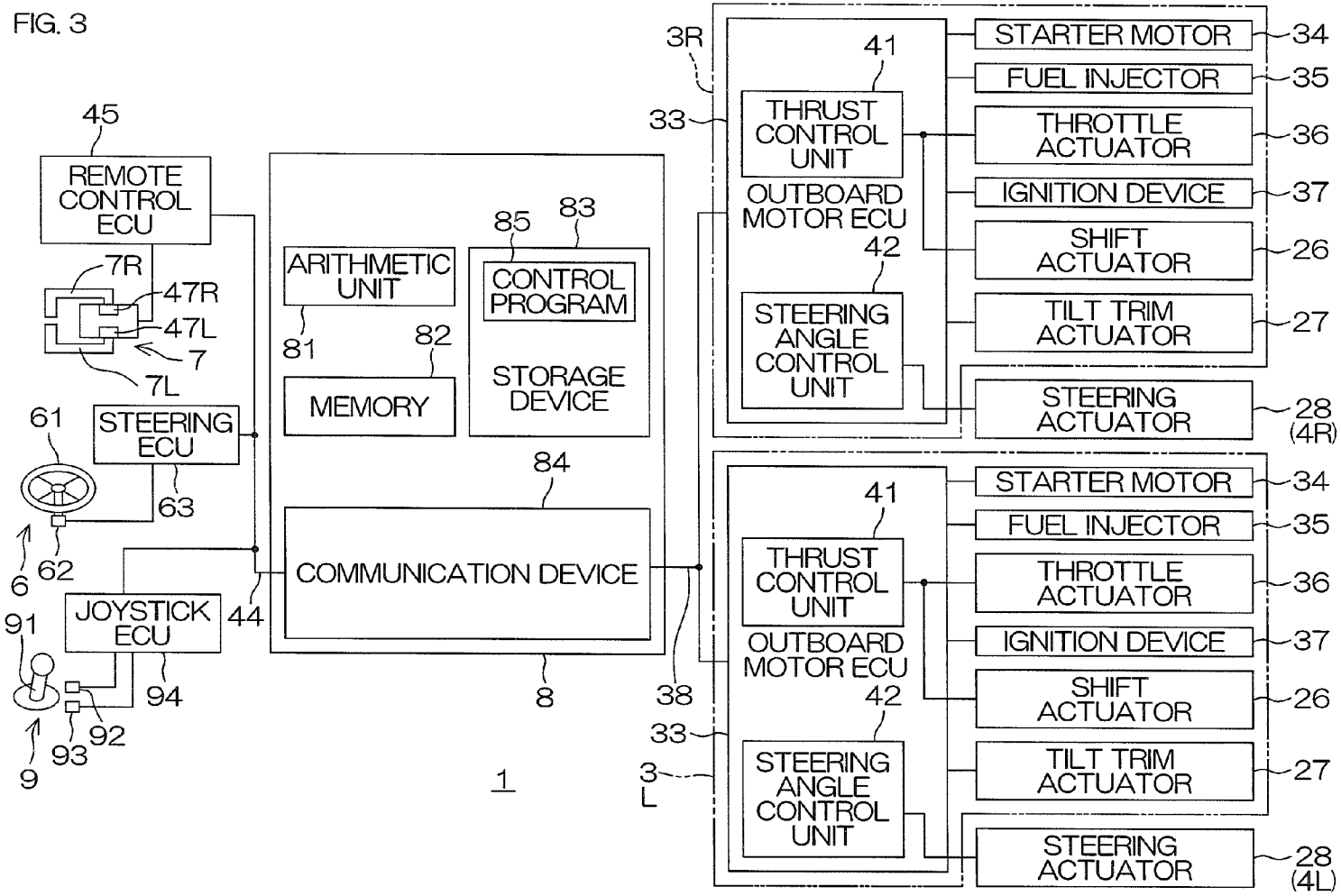
FIG. 3 is a block diagram to describe an electrical arrangement of the vessel.

FIG. 3 is a block diagram to describe an electrical arrangement of the vessel 1. An equipment network system including the central controller 8 is provided on the vessel 1. The equipment network system includes the outboard motors 3L and 3R, the steering operation device 6, the remote control device 7, and the central controller 8.

Each outboard motor 3 includes an outboard motor ECU (electronic control unit) 33, a starter motor 34, a fuel injector 35, a throttle actuator 36, an ignition device 37, the shift actuator 26, the tilt trim actuator 27, etc. The outboard motor ECU 33 controls the operations of the starter motor 34, the fuel injector 35, the throttle actuator 36, the ignition device 37, the shift actuator 26, and the tilt trim actuator 27. The outboard motor ECU 33 additionally controls the steering actuator 28 of the steering mechanism 4.

The starter motor 34 starts the engine 12. The fuel injector 35 injects fuel that is supplied to the combustion chamber of the engine 12. The throttle actuator 36 varies the opening degree of a throttle valve of the engine 12. The ignition device 37 ignites an air-fuel mixture in the combustion chamber. The shift actuator 26 drives the shift rod 25, and switches the position (shift position) of the dog clutch 24 to any one of the forward position, the neutral position, and the backward position. The tilt trim actuator 27 rotates the outboard motor 3 around the tilt shaft 31. The steering actuator 28 rotates the outboard motor 3 around the steering shaft 32.

The outboard motor ECU 33 stores a control program of the engine 12 in an internal memory (not shown). The outboard motor ECU 33 functionally includes a thrust control unit 41 and a steering angle control unit 42. The thrust control unit 41 is configured and programmed to control the magnitude of a thrust of the outboard motor 3 and the shift position (direction of the thrust) mainly by controlling the shift actuator 26 and the throttle actuator 36. The steering angle control unit 42 is configured and programmed to control the steering angle of the outboard motor 3 by controlling the steering actuator 28 of the steering mechanism 4.

The outboard motor ECU 33 is connected to the central controller 8 through a communication line 38. An output command signal and a steering command signal according to the input from the steering operation device 6 and from the remote control device 7 are input from the central controller 8 into the outboard motor ECU 33. Additionally, detection signals of various sensors (not shown) mounted on the outboard motor 3 and on the steering mechanism 4 are input into the outboard motor ECU 33. Based on these command signals and detection signals, the outboard motor ECU 33 controls the operations of the starter motor 34, the fuel injector 35, the throttle actuator 36, the ignition device 37, the shift actuator 26, the tilt trim actuator 27, the steering actuator 28, etc. The outboard motor ECU 33 communicates with the central controller 8 by use of a CAN (Control Area Network) protocol.

The remote control device 7 includes a remote control ECU 45. The remote control ECU 45 is configured and programmed to communicate with the central controller 8 through a communication line 44. In this preferred embodiment, the remote control device 7 includes the two levers 7L and 7R and two operational position sensors 47L and 47R that detect the operational positions of the levers 7L and 7R, respectively. Output signals of the operational position sensors 47L and 47R are input into the remote control ECU 45, and are transmitted from the remote control ECU 45 to the central controller 8 through the communication line 44. The levers 7L and 7R are operation members tiltable in the front-rear direction. In accordance with the tilt positions in the front-rear direction of the levers 7L and 7R, the central controller 8 sends an output command signal, which includes a shift command signal and an engine speed command signal, to the outboard motor ECU 33 of the corresponding outboard motor 3L or 3R. As a result, the outboard motor ECU 33 drives the shift actuator 26 in accordance with the shift command signal, and drives the throttle actuator 36 in accordance with the engine speed command signal. As a result, by operating the levers 7L and 7R, the shift positions of the outboard motors 3L and 3R are switched, and the throttle opening degree is varied. This makes it possible to set the direction of the thrust of the outboard motors 3L and 3R, the generation/non-generation of the thrust, and the output. The output of the outboard motor 3 denotes the magnitude of a thrust, and, more specifically, denotes the engine speed.

The steering operation device 6 includes a steering wheel 61, a steering operation position sensor 62, and a steering ECU 63. The steering operation position sensor 62 detects the operational amount of the steering wheel 61, i.e., the operational angle of the steering wheel 61. The operational angle detected by the steering operation position sensor 62 is transmitted from the steering ECU 63 to the central controller 8 through the communication line 44. The central controller 8 sends a steering command signal corresponding to the operational angle to the outboard motor ECU 33 of the outboard motors 3L and 3R. Based on the steering command signal, the outboard motor ECU 33 drives the steering actuator 28. As a result, the outboard motor 3 is steered in accordance with the operational angle of the steering wheel 61.

The joystick device 9 includes a stick 91 that is operated by the vessel operator, a tilt position sensor 92 that detects the tilted direction and the tilt amount of the stick 91, a rotational position sensor 93 that detects the rotational position of the stick 91, and a joystick ECU 94. The output signal of the tilt position sensor 92 and the output signal of the rotational position sensor 93 are input into the joystick ECU 94. The joystick ECU 94 generates a course command corresponding to the tilted direction of the stick 91, a thrust command corresponding to the tilt amount of the stick 91, and a turning command corresponding to the rotational direction and the rotational amount of the stick 91. The course command, thrust command, and turning command are input into the central controller 8 through the communication line 44. Based on the course command, the thrust command, and the turning command, the central controller 8 generates an output command signal with respect to each of the outboard motors 3L and 3R (shift command signal and engine speed command signal) and a steering command signal. In other words, an output command signal and a steering command signal are calculated so that a thrust indicated by the thrust command in a direction indicated by the course command is generated and so that the hull 2 is turned in accordance with the turning command.

The central controller 8 has a plurality of control modes. One control mode is an ordinary mode, and another control mode is a joystick mode. In the ordinary mode, the central controller 8 outputs a steering command signal corresponding to the operational angle of the steering wheel 61, and outputs an engine speed command signal and a shift command signal corresponding to the operational position of each of the levers 7L and 7R of the remote control device 7. In the joystick mode, the central controller 8 outputs a steering command signal and an output command signal (course command, thrust command, and turning command) corresponding to the output signal of the joystick device 9.

The central controller 8 is configured and programmed to function as a network host of the equipment network system. The central controller 8 includes an arithmetic unit 81, such as a CPU, a memory 82, a storage device 83, and a communication device 84. The storage device 83 may be a fixed storage medium that is composed of a hard disk, a flash memory, etc., or may be a detachable storage medium, such as a memory card or a USB memory. A control program 85 executed by the arithmetic unit 81 is stored in the storage device 83. The arithmetic unit 81 executes the control program 85, such that the central controller 8 performs a control operation under the ordinary mode and a control operation under the joystick mode. The communication device 84 includes a plurality of ports to which the outboard motors 3L and 3R, the steering operation device 6, the remote control device 7, and the joystick device 9 are connected.

Figure 4:
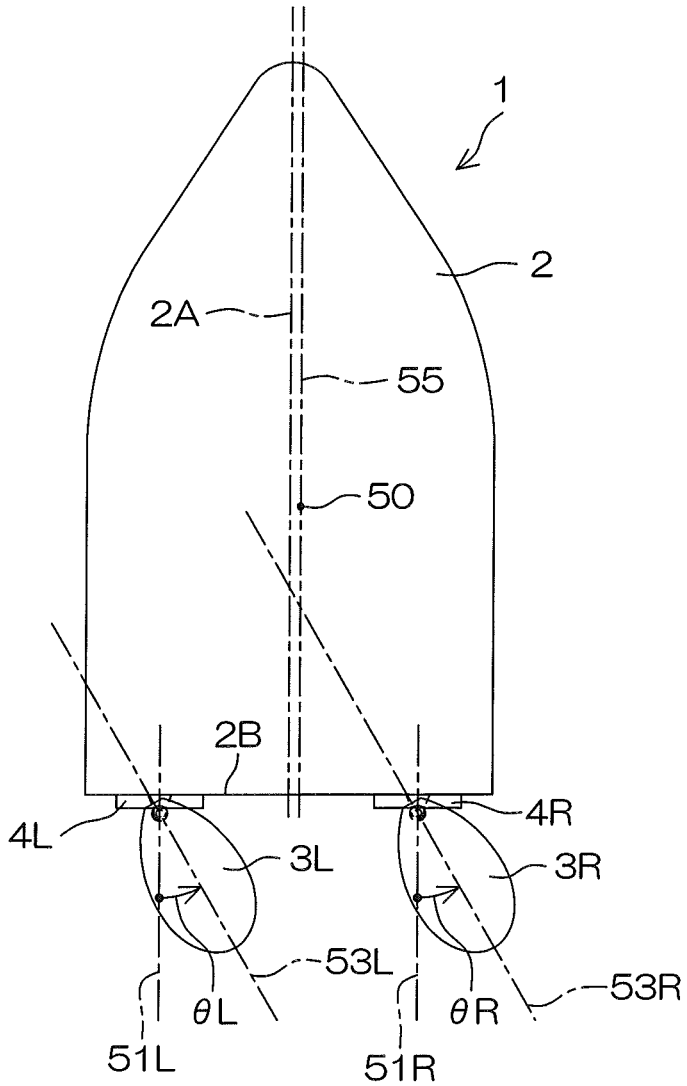

FIG. 4 is a pictorial plan view to describe the disposition of the outboard motor 3 and so on. The portside outboard motor 3L is disposed on the left side with respect to a hull center line 2A that halves the hull 2 in the right-left direction when viewed in plan. The starboard outboard motor 3R is disposed on the right side with respect to the hull center line 2A. The hull center line 2A extends in the front-rear direction of the hull 2.

The portside outboard motor 3L and the starboard outboard motor 3R are attached to the stern 2B of the hull 2 in a state of being swingable (steerable) in the right-left direction. There is no mechanical connection between the left and right outboard motors 3L and 3R, and these outboard motors 3L and 3R are steered by the steering mechanisms 4L and 4R, respectively, independently of each other. The portside outboard motor 3L is steerable by an angle equal rightwardly and leftwardly (for example, about 30 degrees on the right side and about 30 degrees on the left side) with respect to a steering center line (hereinafter, referred to as a "portside steering center line") 51L that is parallel to the hull center line 2A. Likewise, the starboard outboard motor 3R is steerable by an angle equal rightwardly and leftwardly (for example, about 30 degrees on the right side and about 30 degrees on the left side) with respect to a steering center line (hereinafter, referred to as a "starboard steering center line") 51R that is parallel to the hull center line 2A. The portside steering center line 51L and the starboard steering center line 51R extend in the front-rear direction through attachment portions with respect to the hull 2 of the portside outboard motor 3L and the starboard outboard motor 3R, respectively. Thrusts generated by the portside outboard motor 3L and the starboard outboard motor 3R act on the hull 2 at their attachment portions.

The steering angle of the outboard motor 3 is defined based on the front-rear direction of the hull 2, i.e., based on the hull center line 2A, and the steering direction (counterclockwise direction when viewed in plan) in which the outboard motor 3 rightwardly moves is defined as a positive steering direction, and the steering direction (clockwise direction when viewed in plan) in which the outboard motor 3 leftwardly moves is defined as a negative steering direction. The steering angle is an angle of the rotational axis of the propeller 13 (hereinafter, referred to as the "propeller rotational axis") with respect to the hull center line 2A when viewed in plan. Straight lines along the acting directions of thrusts respectively generated by the outboard motors 3L and 3R by the rotation of the respective propellers 13 are hereinafter referred to as "thrust action lines 53L, 53R". In FIG. 4, the thrust action lines 53L and 53R are illustrated as straight lines such that they are coincident with the propeller rotational axes of the outboard motors 3L and 3R, respectively, for convenience. However, in reality, the thrust action lines 53L and 53R do not necessarily coincide with the respective propeller rotational axes of the outboard motors 3L and 3R because of the propeller counter torque. Hereinafter, when appropriate, the thrust action line 53L of the portside outboard motor 3L is referred to as the "portside thrust action line 53L," and the thrust action line 53R of the starboard outboard motor 3R is referred to as the "starboard thrust action line 53R."

The portside steering center line 51L corresponds to the steering neutral position of the port side outboard motor 3L. Likewise, the starboard steering center line 51R corresponds to the steering neutral position of the starboard outboard motor 3R. The steering angle of the portside outboard motor 3L (hereinafter, referred to as the "portside steering angle") θL is an angle of the propeller rotational axis of the portside outboard motor 3L with respect to the portside steering center line 51L. Likewise, the steering angle of the starboard outboard motor 3R (hereinafter, referred to as the "starboard steering angle") θR is an angle of the propeller rotational axis of the starboard outboard motor 3R with respect to the starboard steering center line 51R.

When the propeller rotational axis of the portside outboard motor 3L is parallel to the hull center line 2A, the portside steering angle θL is zero. When the propeller rotational axis of the portside outboard motor 3L intersects the hull center line 2A behind the portside outboard motor 3L, the portside steering angle θL has a positive value. When the propeller rotational axis of the portside outboard motor 3L intersects the hull center line 2A ahead of the portside outboard motor 3L, the portside steering angle θL has a negative value. On the other hand, when the propeller rotational axis of the starboard outboard motor 3R is parallel to the hull center line 2A, the starboard steering angle θR is zero. When the propeller rotational axis of the starboard outboard motor 3R intersects the hull center line 2A ahead of the starboard outboard motor 3R, the starboard steering angle θR has a positive value. When the propeller rotational axis of the starboard outboard motor 3R intersects the hull center line 2A behind the starboard outboard motor 3R, the starboard steering angle θR has a negative value. FIG. 4 shows a state where both the portside and starboard steering angle θL and θR take respective positive values.

The rotation of the hull 2 around the rotational center 50 is called "turning round." In other words, the rotational center 50 is a center position when the hull 2 turns round. Although the position of the rotational center 50 roughly coincides with the position of the center of gravity of the hull 2, there is a case in which it depends on the arrangement of equipment and loads on the vessel 1, and depends on the traveling speed. A line that passes through the rotational center 50 and that extends in the front-rear direction of the hull 2 will be referred to as a hull central line 55. The rightward/leftward position of the hull central line 55 depends on the position of the rotational center 50. Therefore, there is a case in which the hull central line 55 coincides with the hull center line 2A, or does not coincide therewith. Even if the rotational center 50 is movable, the portside outboard motor 3L is positioned leftwardly from the hull central line 55, and the starboard outboard motor 3R is positioned rightwardly from the hull central line 55. The portside outboard motor 3L and the starboard outboard motor 3R are two propulsion devices arranged so as to be disposed on the left side and on the right side, respectively, with respect to the hull central line 55 and so as to be variable in thrust and in steering angle.

The rotational center 50 may be regarded as being placed at a fixed position for the purpose of control of the thrust and the steering angle by the central controller 8. Such a fixed position may be the position of the center of gravity of the hull 2, or may be set based on a hull behavior during test travel. The actual rotational center 50 varies in accordance with, for example, the traveling speed as mentioned above. Therefore, the position of the rotational center 50 may be set to be variable in accordance with the traveling speed. Additionally, the central controller 8 may be configured and programmed to perform a control operation by regarding the hull central line 55 as coinciding with the hull center line 2A.

Figure 5A:
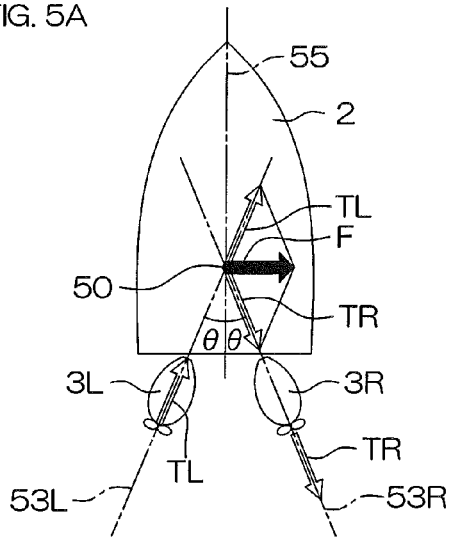
FIG. 5A (comparative example) and FIG. 5B (preferred embodiment) are pictorial plan views to describe one characteristic operation in a joystick mode.
Figure 5B:
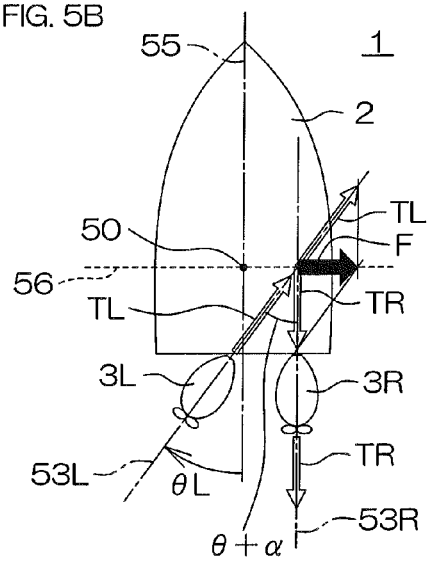

FIG. 5A and FIG. 5B are pictorial plan views to describe a characteristic operation in a joystick mode, and shows the steering angle and the thrust of each of the outboard motors 3L and 3R in a case that the stick 91 of the joystick device 9 is tilted rightwardly to cause the hull 2 to make a lateral movement rightwardly. FIG. 5A and FIG. 5B show an example in which the hull central line 55 substantially coincides with the hull center line 2A. FIG. 5A shows an operation example of a comparative example, and FIG. 5B shows a characteristic operation example of a lateral movement according to a preferred embodiment of the present invention.

The joystick device 9 is one example of an operating device configured to output a lateral movement command by allowing an operator to perform an operation to tilt the stick 91 rightwardly or leftwardly. The lateral movement command includes a commanded direction of either a rightward direction or a leftward direction corresponding to the tilted direction of the stick 91 as a course command, and is a command to cause the hull 2 to make a lateral movement in the lateral direction (tilted direction of the stick 91) perpendicular to the hull central line 55.

In the operation example of the comparative example shown in FIG. 5A, the thrust action lines 53L and 53R of the left and right outboard motors 3L and 3R intersect each other at the rotational center 50. In other words, the portside outboard motor 3L and the starboard outboard motor 3R generate thrusts TL and TR, respectively, along the thrust action lines 53L and 53R symmetrical with respect to the hull central line 55. The portside steering angle θL and the starboard steering angle θR are therefore controlled such that the thrust action lines 53L and 53R are symmetric with respect to the hull central line 53 and intersect each other at the rotational center 50. The magnitude relationship between the thrusts TL and TR is expressed as TL=TR. The shift position of the portside outboard motor 3L is set at a forward position, whereas the shift position of the starboard outboard motor 3R is set at a backward position. Therefore, the thrust TL of the portside outboard motor 3L is in a forward direction along the portside thrust action line 53L. The thrust TR of the starboard outboard motor 3R is in a backward direction along the starboard thrust action line 53R. The resultant force F of the thrusts TL and TR has its operating point at the rotational center 50 at which the thrust action lines 53L and 53R intersect each other, and follows a rightward direction perpendicular to the hull central line 55. Therefore, the resultant force F in the rightward direction acts on the hull 2, and the hull 2 makes a lateral movement rightwardly. Because the operating point of the resultant force F coincides with the rotational center 50, the resultant force F does not provide a moment to the hull 2. Therefore, the hull 2 makes a lateral movement rightwardly without turning round.

It is necessary to set the magnitude of the forward thrust TL and that of the backward thrust TR to be equal with each other, and therefore, when TL=TR=Maximum Backward Thrust Force, the magnitude of the resultant force F reaches the maximum. The reason is that the maximum forward thrust is greater than the maximum backward thrust in the outboard motor 3 as mentioned above. Therefore, the maximum value of the resultant force F in the example of FIG. 5A is determined by the maximum backward thrust.

On the other hand, in the operation example of the preferred embodiment of FIG. 5B, the thrust action line 53R of the starboard outboard motor 3R coincides with the front-rear direction line parallel to the hull central line 55. In other words, the starboard steering angle θR is controlled such that the starboard thrust action line 53R is parallel to the hull central line 55. The shift position of the starboard outboard motor 3R is set at a backward position. Therefore, the thrust TR of the starboard outboard motor 3R is directed backwardly along the starboard steering center line 51R. On the other hand, the thrust action line 53L of the portside outboard motor 3L intersects the hull central line 55 from the left ahead of the portside outboard motor 3L and behind the rotational center 50. Therefore, the portside steering angle θL is controlled such that the portside thrust action line 53L intersects the hull central line 50 from the left ahead of the portside outboard motor 3L and behind the rotational center 50. The portside thrust action line 53L intersects the starboard thrust action line 53R on the right-left direction line 56 that extends perpendicularly to the hull central line 55 through the rotational center 50. In other words, an intersection between the portside thrust action line 53L and the starboard thrust action line 53R is on the right side with respect to the hull central line 55. In other words, the operating point of the resultant force F of the thrust TL of the portside outboard motor 3L and the thrust TR of the starboard outboard motor 3R lies on the right side with respect to the hull central line 55, and lies on the right-left direction line 56. The shift position of the portside outboard motor 3L is set at a forward position. Therefore, the thrust TL of the portside outboard motor 3L is directed forwardly along the thrust action line 53L. Additionally, the magnitude of the thrust TL of the portside outboard motor 3L and that of the thrust TR of the starboard outboard motor 3R are controlled so that the resultant force F follows a direction along the right-left direction line 56 and so that the magnitude of the resultant force F corresponds to the tilt amount (thrust command) of the stick 91. In this case, the magnitude of the forward thrust TL generated by the portside outboard motor 3L becomes greater than that of the backward thrust TR generated by the starboard outboard motor 3R. Because the line of action of the resultant force F passes through the rotational center 50, the resultant force F does not provide a moment to the hull 2. The hull 2 therefore moves rightward laterally without turning round. The line of action of the resultant force F denotes a straight line extending in the acting direction of the resultant force F passing through the operation point of the resultant force F. In the example of FIG. 5B, the line of action of the resultant force F coincides with the right-left direction line 56.

In the case of FIGS. 5A and 5B, it is assumed that the backward thrusts TR in the respective cases are set equal to each other, and that the forward thrusts in the respective cases are set so that the resultant force F follows the right-left direction line 56. In this case, the component of the forward thrust TL in parallel with the right-left direction line 56 is greater in the case of FIG. 5B than in the case of FIG. 5A. That is, the contribution by the forward thrust TL to the resultant force F along the right-left direction line 56 is greater in the case of FIG. 5B than in the case of FIG. 5A. As a result, the resultant force F is greater in the case of FIG. 5B than in the case of FIG. 5A. Specifically, even though the backward thrust TR is the same, the forward thrust TL is made greater in the case of FIG. 5B, so that the greater resultant force F is obtained than that in the case of FIG. 5A, thus resulting in a great lateral thrust accordingly.

Figures 6A, 6B, 6C, 6D, 6E, 6F:
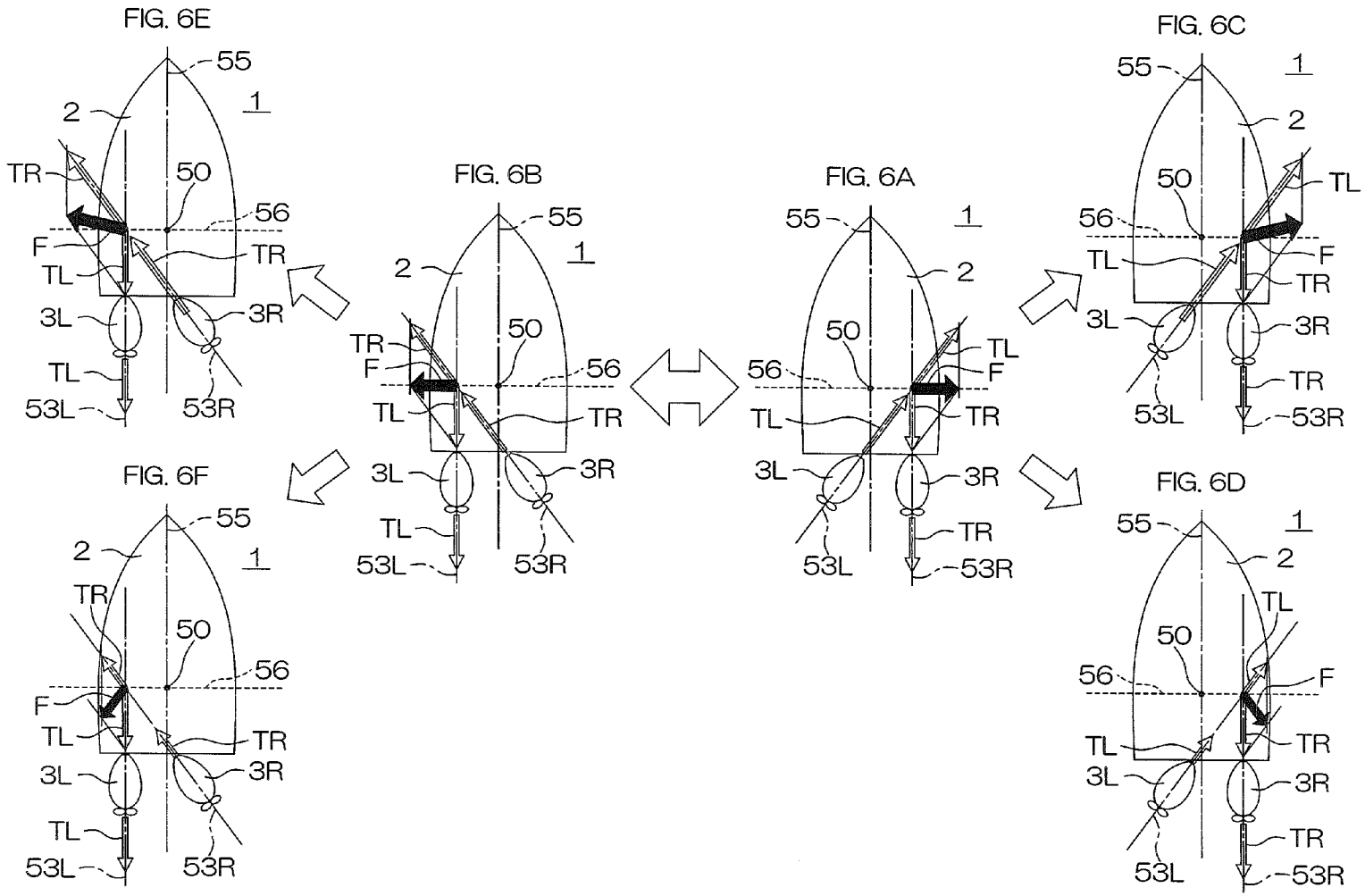
FIG. 6A to FIG. 6F are views to describe one example of lateral and oblique movements in the joystick mode.

FIG. 6A to FIG. 6F are views to describe one example of lateral and oblique movements in the joystick mode. FIG. 6A shows a control state of a rightward lateral movement (same as in FIG. 5B) when the stick 91 of the joystick device 9 is tilted rightwardly. FIG. 6B shows a control state of a leftward lateral movement when the stick 91 of the joystick device 9 is tilted leftwardly. The control state (FIG. 6B) of the leftward lateral movement is laterally symmetrical with respect to the hull central line 55 in comparison with the case of the rightward lateral movement (FIG. 6A and FIG. 5B). More specifically, the portside thrust action line 53L coincides with the front-rear direction line parallel to the hull central line 55. The portside steering angle θL is therefore controlled such that the portside thrust action line 53L is parallel to the hull central line 55. The shift position of the portside outboard motor 3L is set at the backward position. Therefore, the thrust TL of the portside outboard motor 3L is directed backwardly along the portside steering center line 51L. On the other hand, the thrust action line 53R of the starboard outboard motor 3R intersects the hull central line 55 from the right ahead of the starboard outboard motor 3R and behind the rotational center 50, and intersects the thrust action line 53L of the portside outboard motor 3L. Therefore, the starboard steering angle θR is controlled such that the starboard thrust action line 53R intersects the hull central line 55 from the right ahead of the starboard outboard motor 3R and behind the rotational center 50. An intersection between the thrust action lines 53L and 53R is on the right-left direction line 56 which is passing through the rotational center 50. The shift position of the starboard outboard motor 3R is set at the forward position, and the starboard outboard motor 3R generates a thrust TR in the forward direction along the thrust action line 53R. The operating point of the resultant force F of the thrusts TL and TR of the portside outboard motor 3L and the starboard outboard motor 3R lies on an intersection between the thrust action lines 53L and 53R, and lies on the right-left direction line 56 passing through the rotational center 50. Additionally, the magnitudes of the thrusts TL and TR of the portside outboard motor 3L and the starboard outboard motor 3R are controlled so that the line of action of the resultant force F coincides with the right-left direction line 56 and so that the magnitude of the resultant force F corresponds to the tilt amount (thrust command) of the stick 91. As a result, the resultant force F is directed leftwardly to be perpendicular to the hull central line 55, and hence provides a thrust to cause a leftward lateral movement to the hull 2. In this case, the magnitude of the forward thrust TR generated by the starboard outboard motor 3R is greater than that of the backward thrust TL generated by the portside outboard motor 3L. Therefore, the forward thrust TR greatly contributes to the resultant force F which is along the right-left direction line 56 in the same way as in FIG. 5B, and therefore the resultant force F having a great magnitude is attained. The thrust in the forward direction is effectively used for a lateral movement, accordingly, thus obtaining a great lateral thrust.

A specific operation performed when the joystick device 9 outputs a lateral movement command (a course command in the rightward direction or in the leftward direction) is as follows. The central controller 8 is configured and programmed perform a control operation so that one of the two outboard motors 3L and 3R that is disposed on the side in a commanded direction of the lateral movement command with respect to the hull central line 55 generates a backward thrust and so that the other outboard motor that is disposed on the side in a direction opposite to the commanded direction with respect to the hull central line 55 generates a forward thrust. In other words, the central controller 8 generates shift commands corresponding to such thrust directions, and sends the shift commands to the respective outboard motor ECUs 33 of the outboard motors 3L and 3R. As a result, the thrust control unit 41 of each outboard motor ECU 33 controls the shift actuator 26, and controls the shift position of corresponding outboard motor 3 in accordance with the shift command. Additionally, the central controller 8 generates engine speed commands and steering angle commands so that the operating point of the resultant force F of the thrusts TL and TR of the outboard motors 3L and 3R deviates to the side in the commanded direction from the hull central line 55 and so that the direction of action of the resultant force F follows the commanded direction. Still additionally, the central controller 8 sets the engine speed commands so that the magnitude of the resultant force F corresponds to the tilt amount of the stick 91. The central controller 8 sends the engine speed commands and the steering angle commands to the respective outboard motor ECUs 33 of the outboard motors 3L and 3R. The thrust control unit 41 of the each outboard motor ECU 33 is configured and programmed to control the engine speed in accordance with the engine rotation speed command, and, as a result, the magnitudes of the thrusts TL and TR are controlled. In this case, the thrust of one of the two outboard motors 3L and 3R that generates a forward thrust is greater than the thrust of the other outboard motor that generates a backward thrust. Additionally, the steering angle control unit 42 of the each outboard motor ECU 33 is configured and programmed to control the steering actuator 28 in accordance with the steering angle command, and, as a result, the steering angles θL and θR of the respective outboard motors 3 are matched to the corresponding steering angle commands. As described above, the central controller 8 is one example of a controller configured and programmed to control the thrusts TL and TR and the steering angles θL and θR of the two outboard motors 3L and 3R.

In this preferred embodiment, the central controller 8 is configured and programmed to generate steering angle commands for the two outboard motors 3L and 3R so that the operating point of the resultant force F is positioned on the right-left direction line 56 passing through the rotational center 50 when the joystick device 9 outputs a lateral movement command. Additionally, the central controller 8 is configured and programmed to generate steering angle commands that control the steering angles of the outboard motors 3L, 3R so that the thrust of one of the two outboard motors 3L and 3R that generates a backward thrust (i.e., the thrust of the outboard motor disposed on the side in the commanded direction with respect to the hull central line 55) follows a straight traveling direction.

FIG. 6C shows a state in which a forward thrust TL generated by the portside outboard motor 3L is made greater than that of FIG. 6A, and FIG. 6D shows a state in which a forward thrust TL generated by the portside outboard motor 3L is made smaller than that of FIG. 6A. These correspond to cases in which the stick 91 of the joystick device 9 has been tilted rightwardly and thereafter the stick 91 is tilted diagonally forward and right (FIG. 6C) and diagonally backward and right (FIG. 6D), respectively. In these cases, following the lateral movement command in the rightward direction, the joystick device 9 outputs a diagonal movement command (a course command that orders the diagonal direction) that commands a movement in the diagonal direction having a component of a commanded direction (rightward direction) of the lateral movement command. The diagonal movement command denotes the output that orders a movement of the hull 2 in a diagonal direction which diagonally intersects the hull central line 55.

The operating point of the resultant force F is the same as in the case of FIG. 6A, while the direction and the magnitude of the resultant force F vary. In the case of FIG. 6C, the resultant force F is directed right forwardly, and its magnitude is greater than that of FIG. 6A. More specifically, the central controller 8 is configured and programmed to increase the engine speed of the portside outboard motor 3L that generates a forward thrust TL without changing the respective directions of the thrust action lines 53L and 53R of the outboard motors 3L and 3R. As a result, the forward thrust TL generated by the portside outboard motor 3L becomes greater. In the case of FIG. 6D, the resultant force F is directed right backwardly, and its magnitude is smaller than that of FIG. 6A. More specifically, the central controller 8 decreases the engine speed of the portside outboard motor 3L that generates a forward thrust TL without changing the respective directions of the thrust action lines 53L and 53R of the outboard motors 3L and 3R. As a result, the forward thrust TL generated by the portside outboard motor 3L becomes smaller.

In the case of FIG. 6C, the hull 2 moves diagonally forward and right, and, in the case of FIG. 6D, the hull 2 moves diagonally backward and right. Additionally, in the cases of FIGS. 6C and 6D, the resultant force F has the operating point at a position spaced away from the rotational center 50, and the line of action of the resultant force F does not pass through the rotational center 50, and therefore the resultant force F provides a slight moment to the hull 2. More specifically, a moment in the counterclockwise direction is provided to the hull 2 when viewed in plan in the case of FIG. 6C, and therefore the hull 2 moves diagonally forward and right while turning round to the left (counterclockwise). In the case of FIG. 6C, a clockwise moment is provided to the hull 2 when viewed in plan, and therefore the hull 2 moves diagonally backward and right while turning round to the right (clockwise).

FIG. 6E shows a state in which a forward thrust TR generated by the starboard outboard motor 3R is made greater than that of FIG. 6B, and FIG. 6F shows a state in which a forward thrust TR generated by the starboard outboard motor 3R is made smaller than that of FIG. 6B. These correspond to cases in which the stick 91 of the joystick device 9 has been tilted down leftwardly and thereafter the stick 91 is tilted diagonally forward and left (FIG. 6E) and diagonally backward and left (FIG. 6F), respectively. In these cases, following the lateral movement command in the leftward direction, the joystick device 9 outputs a diagonal movement command that commands a movement in the diagonal direction having a component of a commanded direction (leftward direction) of the lateral movement command.

The operating point of the resultant force F is the same as in the case of FIG. 6B, while the direction and the magnitude of the resultant force F vary. In the case of FIG. 6E, the resultant force F is directed left and forwardly, and its magnitude is greater than that of FIG. 6B. More specifically, the central controller 8 is configured and programmed to increase the engine speed of the starboard outboard motor 3R that generates a forward thrust TR without changing the respective directions of the thrust action lines 53L and 53R of the outboard motors 3L and 3R. As a result, the forward thrust TR generated by the starboard outboard motor 3R is greater. In the case of FIG. 6F, the resultant force F is directed left and backwardly, and its magnitude is smaller than that of FIG. 6B. More specifically, the central controller 8 is configured and programmed to decrease the engine speed of the starboard outboard motor 3R that generates a forward thrust TR without changing the respective directions of the thrust action lines 53L and 53R of the outboard motors 3L and 3R. As a result, the forward thrust TR generated by the starboard outboard motor 3R becomes smaller.

In the case of FIG. 6E, the hull 2 moves diagonally forward and left, and, in the case of FIG. 6F, the hull 2 moves diagonally backward and left. Additionally, in the cases of FIGS. 6E and 6F, the resultant force F has the operating point at a position spaced away from the rotational center 50, and the line of action of the resultant force F does not pass through the rotational center 50, and therefore the resultant force F provides a slight moment to the hull 2. More specifically, a moment in the clockwise direction is provided to the hull 2 when viewed in plan in the case of FIG. 6E, and therefore the hull 2 moves diagonally forward and left while turning round to the right (clockwise). In the case of FIG. 6F, a counterclockwise moment is provided to the hull 2 when viewed in plan, and therefore the hull 2 moves diagonally backward and left while turning round to the left (counterclockwise).

Figures 7A, 7B, 7C, 7D, 7E, 7F:
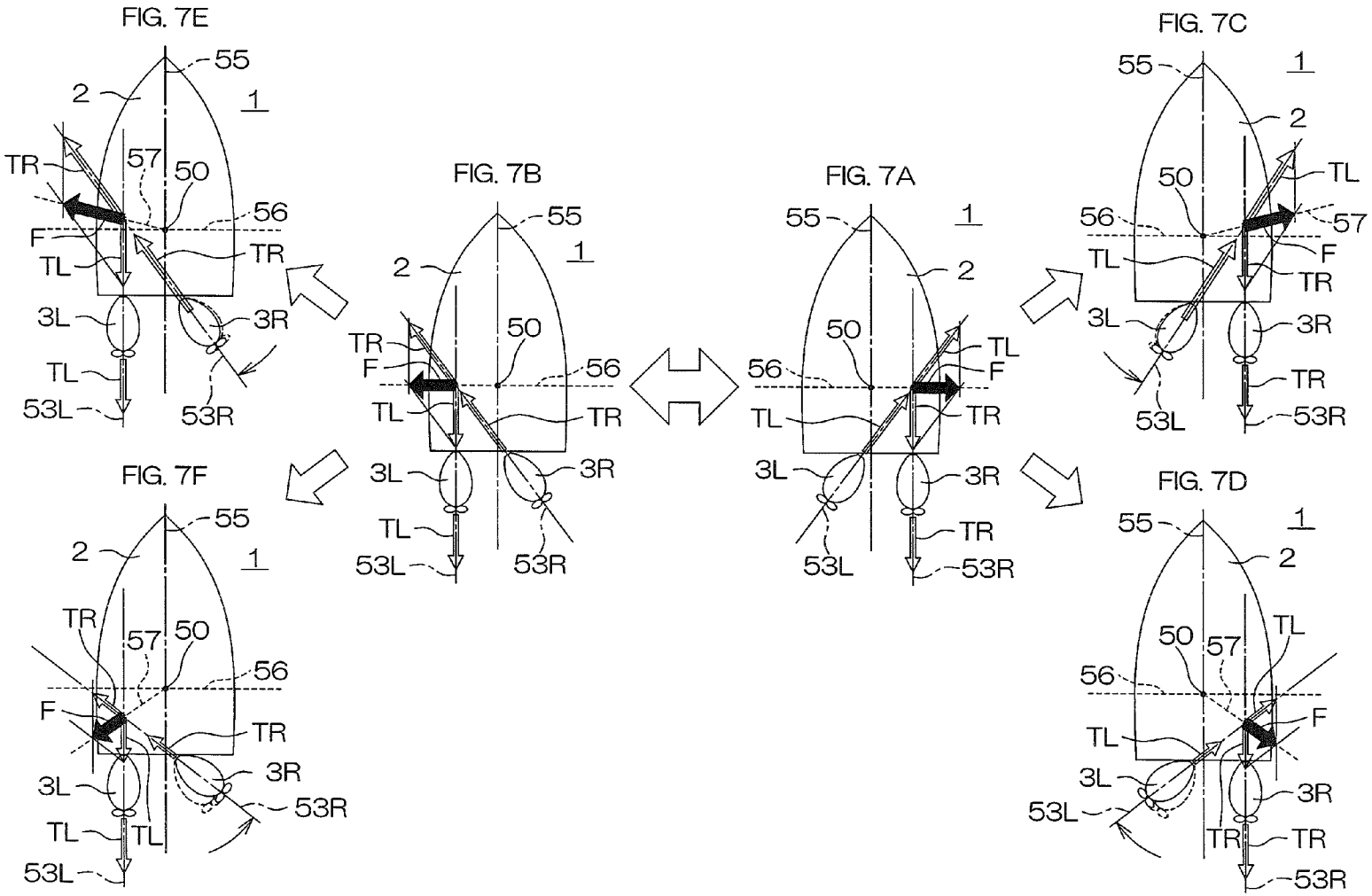
FIG. 7A to FIG. 7F are views to describe another example of lateral and oblique movements in the joystick mode.

FIG. 7A to FIG. 7F are views to describe another example of lateral and oblique movements in the joystick mode. FIG. 7A shows a control state of a rightward lateral movement (same as in FIG. 6A and FIG. 5B), and FIG. 7B shows a control state of a leftward lateral movement (same as in FIG. 6B). Therefore, a description of these is omitted.

FIG. 7C shows a state in which a forward thrust TL generated by the portside outboard motor 3L is made greater than that of FIG. 7A, and the direction of the thrust TL of the portside outboard motor 3L is pointed more forwardly as compared to FIG. 7A. This corresponds to a case in which the stick 91 of the joystick device 9 has been tilted rightwardly and thereafter the stick 91 is tilted diagonally forward and right. In this case, following the lateral movement command in the rightward direction, the joystick device 9 outputs a diagonal movement command that orders a movement in a diagonally forward direction having a component of a commanded direction (rightward direction) of the lateral movement command. In the state of FIG. 7C, the portside thrust action line 53L intersects the starboard thrust action line 53R ahead of the right-left direction line 56 passing through the rotational center 50, and the operating point of the resultant force F is positioned at the intersection. In other words, the central controller 8 is configured and programmed to respond to a diagonally-forward and rightward movement command so as to control the steering angles θL and θR of the two outboard motors 3L and 3R so that the operating point of the resultant force F is positioned ahead of the rotational center 50. More specifically, the central controller 8 is configured and programmed to maintain the starboard steering angle θR (θR=0, for example) as it is, and decreases the absolute value of the portside steering angle θL (<0). On the other hand, the central controller 8 is configured and programmed to control the magnitudes of the thrusts TL and TR of the portside outboard motor 3L and the starboard outboard motor 3R, i.e., controls the engine speeds of the outboard motors 3L and 3R so that a half-line 57, which has been extended diagonally forward and right from the rotational center 50 toward the operating point of the resultant force F, coincides with the line of action of the resultant force F. Therefore, a vector representing the resultant force F lies on the half-line 57, such that the directions of the resultant force F and the half-line are coincident with each other, and the rotational center 50 is on the line of action of the resultant force F. As a result, the resultant force F does not provide a moment to the hull 2. Therefore, the hull 2 moves diagonally forward and right without turning round.

FIG. 7D shows a state in which a forward thrust TL generated by the portside outboard motor 3L is made smaller than that of FIG. 7A, and the direction of the thrust TL of the portside outboard motor 3L is pointed more backwardly as compared to FIG. 7A. This corresponds to a case in which the stick 91 of the joystick device 9 has been tilted rightwardly and thereafter the stick 91 is tilted diagonally backward and right. In this case, following the lateral movement command in the rightward direction, the joystick device 9 outputs a diagonal movement command that orders a movement in a diagonally backward direction having a component of a commanded direction (rightward direction) of the lateral movement command. In the state of FIG. 7D, the portside thrust action line 53L intersects the starboard thrust action line 53R behind the right-left direction line 56 passing through the rotational center 50, and the operating point of the resultant force F is positioned at the intersection. In other words, the central controller 8 is configured and programmed to respond to a diagonally-backward and rightward movement command so as to control the steering angles θL and θR of the two outboard motors 3L and 3R so that the operating point of the resultant force F is positioned behind the rotational center 50. More specifically, the central controller 8 is configured and programmed to maintain the starboard steering angle θR (θR=0, for example) as it is, and increases the absolute value of the portside steering angle θL (<0). On the other hand, the central controller 8 is configured and programmed to control the magnitudes of the thrusts TL and TR of the portside outboard motor 3L and the starboard outboard motor 3R, i.e., control the engine speeds (thrusts) of the outboard motors 3L and 3R so that a half-line 57, which has been extended diagonally backward and right from the rotational center 50 toward the operating point of the resultant force F, coincides with the line of action of the resultant force F. Therefore, a vector representing the resultant force F lies on the half-line 57, such that the directions of the resultant force F and the half-line 57 are coincident with each other, and the rotational center 50 is on the line of action of the resultant force F. As a result, the resultant force F does not provide a moment to the hull 2. Therefore, the hull 2 moves diagonally backward and right without turning round.

FIG. 7E shows a state in which a forward thrust TR generated by the starboard outboard motor 3R is made greater than that of FIG. 7B, and the direction of the thrust TR of the starboard outboard motor 3R is pointed more forwardly as compared to FIG. 7B. This corresponds to a case in which the stick 91 of the joystick device 9 has been tilted leftwardly and thereafter the stick 91 is tilted diagonally forward and left. Following a leftward lateral movement command, the joystick device 9 outputs a diagonal movement command that orders a movement in a diagonally forward direction having a component of a commanded direction (leftward direction) of the lateral movement command. In the state of FIG. 7E, the starboard thrust action line 53R intersects the portside thrust action line 53L ahead of the right-left direction line 56 passing through the rotational center 50, and the operating point of the resultant force F is positioned at the intersection. In other words, the central controller 8 is configured and programmed to respond to a diagonally-forward and leftward movement command so as to control the steering angles θL and θR of the two outboard motors 3L and 3R so that the operating point of the resultant force F is positioned ahead of the rotational center 50. More specifically, the central controller 8 is configured and programmed to maintain the portside steering angle θL (θL=0, for example) as it is, and decreases the absolute value of the starboard steering angle θR (>0). On the other hand, the central controller 8 is configured and programmed to control the magnitudes of the thrusts TL and TR of the portside outboard motor 3L and the starboard outboard motor 3R, i.e., controls the engine speeds (thrust) of the outboard motors 3L and 3R so that a half-line 57, which has been extended diagonally forward and left from the rotational center 50 toward the operating point of the resultant force F, coincides with the line of action of the resultant force F. Therefore, a vector representing the resultant force F lies on the half-line 57, such that the directions of the resultant force F and the half-line 57 are coincident with each other, and the rotational center 50 is on the line of action of the resultant force F. As a result, the resultant force F does not provide a moment to the hull 2. Therefore, the hull 2 moves diagonally forward and left without turning round.

FIG. 7F shows a state in which a forward thrust TR generated by the starboard outboard motor 3R is made smaller than that of FIG. 7B, and the direction of the thrust TR of the starboard outboard motor 3R is pointed more backwardly as compared to FIG. 7B. This corresponds to a case in which the stick 91 of the joystick device 9 has been tilted leftwardly and thereafter the stick 91 is tilted diagonally backward and left. In this case, following a leftward lateral movement command, the joystick device 9 outputs a diagonal movement command that orders a movement in a diagonally backward direction having a component of a commanded direction (leftward direction) of the lateral movement command. In the state of FIG. 7F, the starboard thrust action line 53R intersects the portside thrust action line 53L behind the right-left direction line 56 passing through the rotational center 50, and the operating point of the resultant force F is positioned at the intersection. In other words, the central controller 8 is configured and programmed to respond to a diagonally-backward and leftward movement command so as to control the steering angles θL and θR of the two outboard motors 3L and 3R so that the operating point of the resultant force F is positioned behind the rotational center 50. More specifically, the central controller 8 is configured and programmed to maintain the portside steering angle θL (θL=0, for example) as it is, and increases the absolute value of the starboard steering angle θR (>0). On the other hand, the central controller 8 controls the magnitudes of the thrusts TL and TR of the portside outboard motor 3L and the starboard outboard motor 3R, i.e., controls the engine speeds (thrusts) of the outboard motors 3L and 3R so that a half-line 57, which has been extended diagonally backward and left from the rotational center 50 toward the operating point of the resultant force F, coincides with the line of action of the resultant force F. Therefore, a vector representing the resultant force F lies on the half-line 57, such that the directions of the resultant force F and the half-line 57 are coincident with each other, and the rotational center 50 is on the line of action of the resultant force F. As a result, the resultant force F does not provide a moment to the hull 2. Therefore, the hull 2 moves diagonally backward and left without turning round.

Figures 8A, 8B, 8C, 8D, 8E, 8F:
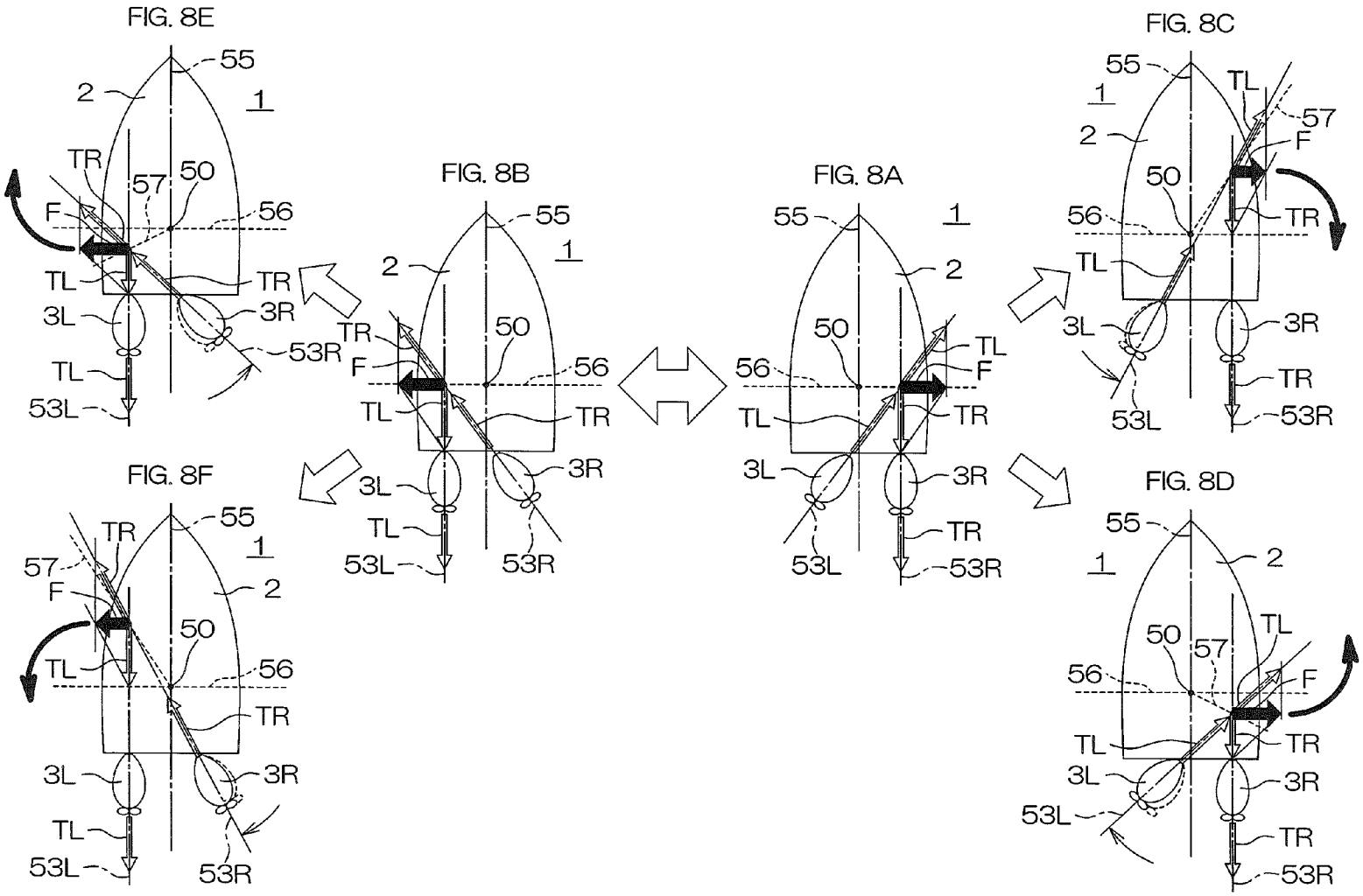
FIG. 8A to FIG. 8F are views to describe still another example of a lateral movement in the joystick mode.

FIG. 8A to FIG. 8F are views to describe still another feature of a lateral movement in the joystick mode. FIG. 8A shows a control state of a rightward lateral movement (same as in FIG. 6A and FIG. 5B), and FIG. 8B shows a control state of a leftward lateral movement (same as in FIG. 6B). Therefore, a description of these is omitted. The control state examples shown in FIGS. 8A-8F are applicable in the case that the joystick device 9 is configured to accept a tilt operation (movement direction command) and a rotation operation (turning command) made on the stick 91.

FIG. 8C shows a state in which the direction of the thrust TL of the portside outboard motor 3L is pointed more forwardly as compared to FIG. 8A. This corresponds to a case in which the stick 91 of the joystick device 9 has been tilted rightwardly, and the stick 91 is thereafter rotated in the clockwise direction. In this case, the joystick device 9 outputs a rightward lateral movement command and a clockwise (right-handed rotational direction) turning command. In the state of FIG. 8C, the portside thrust action line 53L intersects the starboard thrust action line 53R ahead of the right-left direction line 56 passing through the rotational center 50, and the operating point of the resultant force F is positioned at the intersection. In other words, the central controller 8 is configured and programmed to cause the operating point of the resultant force F to deviate ahead of the right-left direction line 56 by changing the steering angle θL (<0) of the portside outboard motor 3L that generates a forward thrust TL (i.e., by decreasing the absolute value). On the other hand, the central controller 8 is configured and programmed to control the magnitudes of the thrusts TL and TR of the portside outboard motor 3L and the starboard outboard motor 3R so that the resultant force F follows the right-left direction (direction perpendicular to the hull central line 55). As a result, it is possible to cause a thrust of a rightward lateral movement to act on the hull 2. A half-line 57 extended from the rotational center 50 toward the operating point of the resultant force F is non-parallel to the vector of the resultant force F. Therefore, the resultant force F has a component in a direction perpendicular to the half-line 57, and the line of action of the resultant force F does not pass through the rotational center 50. Consequently, the resultant force F provides a moment in the clockwise direction to the hull 2 when viewed in plan. Therefore, the hull 2 turns in the clockwise direction while making a rightward lateral movement.

FIG. 8D shows a state in which the direction of the thrust TL of the portside outboard motor 3L is pointed more backwardly as compared to FIG. 8A. This corresponds to a case in which the stick 91 of the joystick device 9 has been tilted rightwardly, and the stick 91 is thereafter rotated in the counterclockwise direction. In this case, the joystick device 9 outputs a rightward lateral movement command and a counterclockwise (left-handed rotational direction) turning command. In the state of FIG. 8D, the portside thrust action line 53L intersects the starboard thrust action line 53R behind the right-left direction line 56 passing through the rotational center 50, and the operating point of the resultant force F is positioned at the intersection. In other words, the central controller 8 is configured and programmed to cause the operating point of the resultant force F to deviate behind the right-left direction line 56 by changing the steering angle θL (<0) of the portside outboard motor 3L that generates a forward thrust TL (i.e., by increasing the absolute value). On the other hand, the central controller 8 is configured and programmed to control the magnitudes of the thrusts TL and TR of the portside outboard motor 3L and the starboard outboard motor 3R so that the resultant force F follows the right-left direction (direction perpendicular to the hull central line 55). As a result, it is possible to cause a thrust of a rightward lateral movement to act on the hull 2. A half-line 57 extended from the rotational center 50 toward the operating point of the resultant force F is non-parallel to the vector of the resultant force F. Therefore, the resultant force F has a component in a direction perpendicular to the half-line 57, and the line of action of the resultant force F does not pass through the rotational center 50. Consequently, the resultant force F provides a moment in the counterclockwise direction to the hull 2 when viewed in plan. Therefore, the hull 2 turns in the counterclockwise direction while making a rightward movement.

FIG. 8E shows a state in which the direction of the thrust TR of the starboard outboard motor 3R is pointed more backwardly as compared to FIG. 8B. This corresponds to a case in which the stick 91 of the joystick device 9 has been tilted leftwardly, and the stick 91 is thereafter rotated in the clockwise direction. In this case, the joystick device 9 outputs a leftward lateral movement command and a clockwise (right-handed rotational direction) turning command. In the state of FIG. 8E, the starboard thrust action line 53R intersects the portside thrust action line 53L behind the right-left direction line 56 passing through the rotational center 50, and the operating point of the resultant force F is positioned at the intersection. In other words, the central controller 8 is configured and programmed to cause the operating point of the resultant force F to deviate behind the right-left direction line 56 by changing the steering angle θR (>0) of the starboard outboard motor 3R that generates a forward thrust TR (i.e., by increasing the absolute value). On the other hand, the central controller 8 is configured and programmed to control the magnitudes of the thrusts TL and TR of the portside outboard motor 3L and the starboard outboard motor 3R so that the resultant force F follows the right-left direction (direction perpendicular to the hull central line 55). As a result, it is possible to cause a thrust of a leftward lateral movement to act on the hull 2. A half-line 57 extended from the rotational center 50 toward the operating point of the resultant force F is non-parallel to the vector of the resultant force F. Therefore, the resultant force F has a component in a direction perpendicular to the half-line 57, and the line of action of the resultant force F does not pass through the rotational center 50. Consequently, the resultant force F provides a moment in the clockwise direction to the hull 2 when viewed in plan. Therefore, the hull 2 turns in the clockwise direction while making a leftward lateral movement.

FIG. 8F shows a state in which the direction of the thrust TR of the starboard outboard motor 3R is pointed more forwardly as compared to FIG. 8B. This corresponds to a case in which the stick 91 of the joystick device 9 has been tilted leftwardly, and the stick 91 is thereafter rotated in the counterclockwise direction. In this case, the joystick device 9 outputs a leftward lateral movement command and a counterclockwise (left-handed rotational direction) turning command. In the state of FIG. 8F, the starboard thrust action line 53R intersects the portside thrust action line 53L ahead of the right-left direction line 56 passing through the rotational center 50, and the operating point of the resultant force F is positioned at the intersection. In other words, the central controller 8 is configured and programmed to cause the operating point of the resultant force F to deviate ahead of the right-left direction line 56 by changing the steering angle θR (>0) of the starboard outboard motor 3R that generates a forward thrust (i.e., by decreasing the absolute value). On the other hand, the central controller 8 is configured and programmed to control the magnitudes of the thrusts TL and TR of the portside outboard motor 3L and the starboard outboard motor 3R so that the resultant force F follows the right-left direction (direction perpendicular to the hull central line 55). As a result, it is possible to cause a thrust of a leftward lateral movement to act on the hull 2. A half-line 57 extended from the rotational center 50 toward the operating point of the resultant force F is non-parallel to the vector of the resultant force F. Therefore, the resultant force F has a component in a direction perpendicular to the half-line 57, and the line of action of the resultant force F does not pass through the rotational center 50. Consequently, the resultant force F provides a moment in the counterclockwise direction to the hull 2 when viewed in plan. Therefore, the hull 2 turns in the counterclockwise direction while making a leftward movement.

As described above, the central controller 8 is configured and programmed to control the steering angles of the two outboard motors 3L and 3R so that, when the joystick device 9 outputs a command to make a rightward lateral movement and a turning command to turn in the clockwise direction, the operating point of the resultant force F is disposed more forwardly than when making a rightward lateral movement. Additionally, the central controller 8 is configured and programmed to control the steering angles of the two outboard motors 3L and 3R so that, when the joystick device 9 outputs a command to make a leftward lateral movement and a turning command to turn in the counterclockwise direction, the operating point of the resultant force F is disposed more forwardly than when making a leftward lateral movement. Additionally, the central controller 8 is configured and programmed to control the steering angles of the two outboard motors 3L and 3R so that, when the joystick device 9 outputs a command to make a rightward lateral movement and a turning command to turn in the counterclockwise direction, the operating point of the resultant force F is disposed more backwardly than when making a rightward lateral movement. Additionally, the central controller 8 is configured and programmed to control the steering angles of the two outboard motors 3L and 3R so that, when the joystick device 9 outputs a command to make a leftward lateral movement and a turning command to turn in the clockwise direction, the operating point of the resultant force F is disposed more backwardly than when making a leftward lateral movement.

Figure 9:
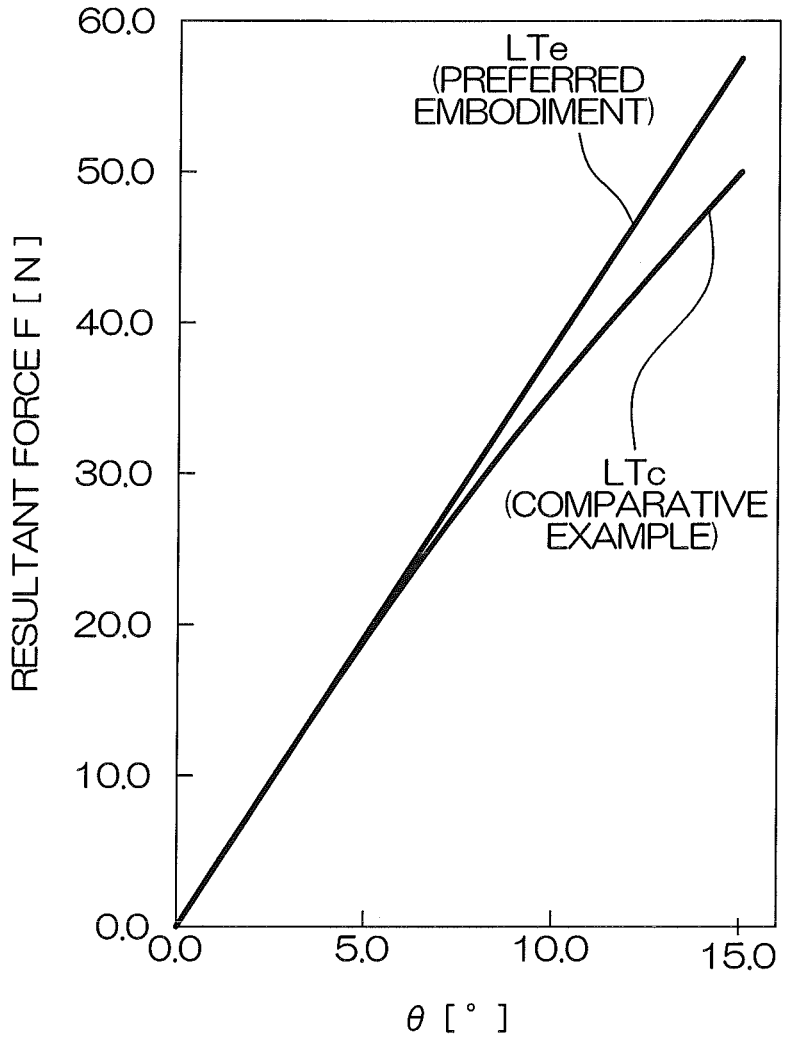
FIG. 9 shows a result obtained by simulating the magnitude of the resultant force of thrusts in the comparative example of FIG. 5A and in the preferred embodiment of FIG. 5B.

FIG. 9 shows a result obtained by simulating the magnitude of the resultant force F in the comparative example of FIG. 5A and in the preferred embodiment of FIG. 5B. The abscissa axis shows the absolute value θ (=|θL|=|θR|>0) of the steering angle of each of the left and right outboard motors 3L and 3R in the comparative example of FIG. 5A. In the preferred embodiment of FIG. 5B, the portside steering angle θL is set so that the portside thrust action line 53L and the starboard thrust action line 53R intersect each other on the right-left direction line 56. More specifically, the absolute value of the portside steering angle θL (<0) is defined as a value obtained by adding a predetermined value α(>0) to the absolute value e of the steering angle in the comparative example (FIG. 5A). In the preferred embodiment of FIG. 5B, the portside steering angle θL equals to the angle (θ+α) defined by the thrust action lines 53L and 53R because the starboard steering angle θR is zero. The backward thrusts TR generated by the starboard outboard motor 3R are set to equal to each other. The line LTc represents the magnitude (lateral thrust) of the resultant force F obtained with respect to a variety of absolute values θ of steering angles in the comparative example (FIG. 5A) with the backward thrust TR kept constant. The line LTe represents the magnitude (lateral thrust) of the resultant force F obtained with respect to a variety of portside steering angles θL (=−(θ+α)) in the present preferred embodiment (FIG. 5B) with the backward thrust TR kept constant.

From a comparison between the line LTc (comparative example) and the line LTe (present preferred embodiment), it is understood that an increase in the lateral thrust has been achieved as a result of the effective contribution of the great forward thrust to the resultant force F in the lateral direction.

As described above, according to the present preferred embodiment, the lateral movement of the hull 2 is achieved by the thrusts of the two outboard motors 3L and 3R disposed on the left and right sides, respectively, with respect to the hull central line 55. When the joystick device 9 outputs a lateral movement command in accordance with the operation of an operator, one of the outboard motors 3L and 3R disposed on the side in a commanded direction is controlled to generate a backward thrust, and the outboard motor disposed on the side in a direction opposite to the commanded direction is controlled to generate a forward thrust. On the other hand, the steering angles of the two outboard motors 3L and 3R are controlled so that the operating point of a resultant force F of those thrusts is positioned to deviate to the side in the commanded direction from the hull central line 55. The thrusts and the steering angles of the two outboard motors 3L and 3R are controlled so that the direction of action of the resultant force F follows the commanded direction. As a result, the hull 2 makes a lateral movement in accordance with the command of the operator. The operating point of the resultant force F of the thrusts of the two outboard motors 3L and 3R is not positioned on the hull central line 55, but is positioned to deviate to the commanded direction side from the hull central line 55, and therefore a forward thrust generated by the outboard motor disposed on the side opposite to the commanded direction side is set to be greater than a backward thrust generated by the outboard motor disposed on the commanded direction side. As a result, the direction of the resultant force F becomes perpendicular to the hull central line 55. Therefore, a forward thrust greater than a backward thrust is used during lateral movement, and therefore it is possible to make a lateral movement that effectively uses the forward thrust. As a result, it is possible to provide a vessel propulsion system improved in lateral movability.

Additionally, in this preferred embodiment, the operating point of the resultant force F is disposed on the right-left direction line 56 that extends perpendicularly to the hull central line 55 through the rotational center 50 of the hull 2 during lateral movement. Therefore, the resultant force F has an operating point on the right-left direction line 56, and acts along the right-left direction line 56, and hence does not provide a moment to the hull 2. As a result, the hull 2 makes a lateral movement without turning round. Accordingly, it is possible to make a lateral movement that effectively uses a forward thrust, and therefore it is possible to improve the lateral movability of the vessel 1.

Additionally, in the present preferred embodiment, the outboard motor (the outboard motor disposed on the commanded direction side with respect to the hull central line 55) that generates a backward thrust generates a thrust along a straight traveling direction during lateral movement. Therefore, the backward thrust of the outboard motor does not substantially contribute to the lateral movement of the hull 2. A thrust component in the lateral direction is provided by the thrust of the outboard motor that generates a forward thrust, and the thrust component in the forward direction is countervailed by the backward thrust of the outboard motor disposed on the commanded direction side. As a result, the hull is caused to make a lateral movement by making the forward thrust greater than the backward thrust, and therefore it is possible to make a lateral movement that effectively uses a forward thrust.

The straight traveling direction is the direction of a thrust generated by an outboard motor when the vessel 1 travels straight. In the present preferred embodiment, the straight traveling direction is the front-rear direction of the hull 2, and is parallel to the hull central line 55. However, the straight traveling direction does not need to be completely parallel to the hull central line 55. For example, the lines 53L and 53R of action of the thrusts of the two outboard motors 3L and 3R may intersect each other to make a so-called toe angle when the vessel travels straight. In this case, the straight traveling direction may be a direction inclined by half the toe angle with respect to the hull central line 55. Additionally, even if it is a case in which the toe angle is set, the front-rear direction of the hull 2 may be set as a straight traveling direction during lateral movement.

Additionally, in the present preferred embodiment, when the operator inputs a lateral movement command into the joystick device 9, and, subsequent thereto, the operator inputs a diagonal movement command to the same side as the lateral movement command in a joystick mode, the hull 2 is diagonally moved by increasing or decreasing the thrust of the outboard motor that generates a forward thrust. As a result, it is possible to achieve the diagonal movement of the hull 2 by adjusting the forward thrust without greatly changing the steering angles of the outboard motors. More specifically, if the diagonal movement command is a diagonally forward movement command, the forward thrust is increased. If the diagonal movement command is a diagonally backward movement command, the forward thrust is reduced. As a result, it is possible to control the diagonal movement of the vessel 1 by effectively using the forward thrust. Particularly in the case of the outboard motor, the maximum forward thrust is greater than the maximum backward thrust, and therefore the adjustable range of the forward thrust is greater than the adjustable range of the backward thrust. Therefore, it is possible to make a diagonal movement in a wide directional range.

In the operation examples shown in FIG. 7A to FIG. 7F, the operating point of the resultant force F is disposed ahead of the rotational center 50 when a diagonally forward movement command is issued, whereas the operating point of the resultant force F is disposed behind the rotational center 50 when a diagonally backward movement command is issued. Additionally, the half-line 57 drawn from the rotational center 50 toward the operating point of the resultant force F and the line of action of the resultant force F are caused to coincide with each other. In other words, the line of action of the resultant force F passes through the rotational center 50. As a result, the resultant force F does not provide a moment to the hull 2, and therefore it is possible to move the hull 2 in the diagonal direction while preventing the turning of the hull 2.

Additionally, in the present preferred embodiment, the steering angle of the outboard motor generating a forward thrust is changed when the operator additionally inputs a turning command into the joystick device 9 during lateral movement. As a result, the operating point of the resultant force F moves, thus making it possible to provide a moment to the hull 2. Therefore, it is possible to provide a hull behavior of turning round while moving in a direction corresponding to the lateral movement command. In other words, it is possible to control hull behavior while effectively using a forward thrust. More specifically, the operating point of the resultant force F is deviated to a position spaced in the front-rear direction of the vessel 1 from the operating point of the resultant force F positioned during lateral movement. In other words, it is possible to make the turning of the hull 2 simultaneously with a lateral movement by moving the operating point of the resultant force F on a front-rear direction line passing through the operating point of the resultant force F during lateral movement.

It is thus possible to provide a vessel 1 in which a variety of hull behaviors are realized by effectively using the forward thrusts of the outboard motors 3L and 3R.

Although preferred embodiments of the present invention have been described above, the present invention can also be embodied in other configurations including those mentioned below.

A propulsion device may be a device other than an outboard motor. Examples of propulsion devices other than the outboard motor include an inboard motor, an inboard-outboard motor, and a waterjet propulsion device. All of these devices are configured to switch between generating a forward thrust and a backward thrust. An inboard motor and an inboard-outboard motor generate a forward thrust and a backward thrust by rotating a propeller in the forward direction and in the backward direction, respectively, in the same manner as an outboard motor. A waterjet propulsion device includes a nozzle that jets water backwardly and a reverse bucket that is selectively disposed behind the nozzle (downstream side of the nozzle in a direction in which water is jetted). When the reverse bucket is disposed behind the nozzle, a backward thrust is applied to the hull. An inboard-outboard motor, an inboard motor, and a waterjet propulsion device are propulsion devices whose maximum forward thrust is greater than the maximum backward thrust thereof. Steerable angles of these propulsion devices are less than 180 degrees, and, more specifically, less than 90 degrees. A motor serving as a power source of the propulsion device may be an electric motor, and is not limited to an engine.

Three or more propulsion devices may be disposed at the stern. For example, a portside propulsion device, a central propulsion device, and a starboard propulsion device may be disposed in a side-by-side arrangement. In this case, it is possible to achieve the lateral movement, the diagonal movement, and the turning of the hull by performing a thrust control operation and a steering angle control operation for the portside propulsion device and the starboard propulsion device in the same manner as in the aforementioned preferred embodiments. If four or more propulsion devices are disposed at the stern, these devices may be divided into a left-hand propulsion device group and a right-hand propulsion device group with respect to the hull central line, and a thrust control operation and a steering angle control operation may be performed for these two groups in the same manner as for the portside outboard motor and the starboard outboard motor in the aforementioned preferred embodiments.

The steering angle of the outboard motor on the lateral-movement-command direction side is controlled such that the thrust action line of that outboard motor is parallel to the hull central line in the aforementioned preferred embodiments. However, the steering angle of the outboard motor on the lateral-movement-command direction side may be controlled such that the thrust action line of that outboard motor is non-parallel to the hull central line. Additionally, the steering angle of the outboard motor that generates a backward thrust, as well as the steering angle of the outboard motor that generates a forward thrust, may be changed in order to achieve the hull behavior (see FIG. 8) of turning round while making an oblique movement (see FIG. 7) or a lateral movement.

Although the ordinary mode in which the vessel is operated by the steering operation device 6 and by the remote control device 7 is provided in the aforementioned preferred embodiments, this ordinary mode may be omitted. In other words, the steering operation device 6 and the remote control device 7 are not necessarily required. Additionally, the operating device that outputs a lateral movement command etc., may be another type of device without being limited to a joystick device. For example, a lateral movement command etc., may be input by the operational input from a display device having a touch panel function.

The present application corresponds to Japanese Patent Application No. 2013-259486 filed in the Japan Patent Office on Dec. 16, 2013, and the entire disclosure of the application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion system comprising:

at least two propulsion devices that are disposed on a left side and on a right side, respectively, with respect to a central line extending in a front-rear direction through a rotational center of a hull and that are variable in thrust and in steering angle;

an operating device configured to output a lateral movement command to cause the hull to make a lateral movement in a lateral direction perpendicular to the central line, the lateral movement command including a commanded direction of either a rightward direction or a leftward direction in accordance with an operation performed by an operator; and a controller configured and programmed to control the thrust and the steering angle of each of the two propulsion devices so that, when the operating device outputs the lateral movement command, a first one of the two propulsion devices that is disposed on a side existing in the commanded direction with respect to the central line generates a backward thrust, whereas a second one of the two propulsion devices that is disposed on a side existing in a direction opposite to the commanded direction with respect to the central line generates a forward thrust, and so that an operating point of a resultant force of the thrusts of the two propulsion devices is positioned to deviate to the side in the commanded direction from the central line, and so that a direction of action of the resultant force follows the commanded direction.

2. The vessel propulsion system according to claim 1, wherein the controller is configured and programmed to control the steering angles of the two propulsion devices so that the operating point of the resultant force is positioned on a right-left direction line extending perpendicularly to the central line along a right-left direction through the rotational center when the operating device outputs the lateral movement command.

3. The vessel propulsion system according to claim 1, wherein the controller is configured and programmed to control the steering angle of the first propulsion device that generates the backward thrust, so that the thrust of the first propulsion device follows a straight traveling direction; and the straight traveling direction is parallel or substantially parallel to the front-rear direction.

4. The vessel propulsion system according to claim 1, wherein the controller is configured and programmed to control the thrusts of the two propulsion devices so that, when the operating device outputs the lateral movement command, the thrust of the second propulsion device that generates the forward thrust is greater than the thrust of the first propulsion device that generates the backward thrust.

5. The vessel propulsion system according to claim 1, wherein the operating device is configured to output a diagonal movement command to cause a movement in a diagonal direction that obliquely intersects the central line; and the controller is configured and programmed to increase or decrease the thrust of the second propulsion device that generates the forward thrust so that the hull moves in a diagonal direction in response to receipt of a diagonal movement command generated by the operating device being moved diagonally after a lateral movement.

6. The vessel propulsion system according to claim 5, wherein, the controller is configured and programmed to increase the thrust of the second propulsion device that generates the forward thrust responsive to the diagonal movement command being a diagonally forward movement command, and the controller is configured and programmed to decrease the thrust of the second propulsion device that generates the forward thrust responsive to the diagonal movement command being a diagonally backward movement command.

7. The vessel propulsion system according to claim 6, wherein the controller is configured and programmed to control the steering angles of the two propulsion devices so that, responsive to the diagonal movement command being a diagonally forward movement command, the operating point of the resultant force is positioned ahead of the rotational center and so that, responsive to the diagonal movement command being a diagonally backward movement command, the operating point of the resultant force is positioned behind the rotational center.

8. The vessel propulsion system according to claim 1, wherein the controller is configured and programmed to control the steering angles and the thrusts of the two propulsion devices so that a half-line drawn so as to pass through the operating point of the resultant force from the rotational center coincides with a line of action of the resultant force.

9. The vessel propulsion system according to claim 1, wherein the operating device is configured to output a turning command to cause the hull to turn round; and when the operating device outputs the turning command along with the lateral movement command, the controller is configured and programmed to change the steering angle of the second propulsion device that generates the forward thrust to cause the hull to turn round.

10. The vessel propulsion system according to claim 9, wherein the controller is configured and programmed to control the steering angles of the two propulsion devices so that, when the operating device outputs the turning command along with the lateral movement command, the operating point of the resultant force is positioned to deviate in the front-rear direction of the vessel from the operating point of the resultant force during lateral movement.

11. A vessel comprising:

a hull;

at least two propulsion devices that are disposed on a left side and on a right side, respectively, with respect to a central line extending in a front-rear direction through a rotational center of the hull, that are attached to the hull, and that are variable in thrust and in steering angle;

an operating device configured to output a lateral movement command to cause the hull to make a lateral movement in a lateral direction perpendicular to the central line, the lateral movement command including a commanded direction of either a rightward direction or a leftward direction in accordance with an operation performed by an operator; and a controller configured and programmed to control the thrust and the steering angle of each of the two propulsion devices so that, when the operating device outputs a lateral movement command, a first one of the two propulsion devices that is disposed on a side existing in the commanded direction with respect to the central line generates a backward thrust, whereas a second one of the two propulsion devices that is disposed on a side existing in a direction opposite to the commanded direction with respect to the central line generates a forward thrust, and so that an operating point of a resultant force of the thrusts of the two propulsion devices is positioned to deviate to the side in the commanded direction from the central line, and so that a direction of action of the resultant force follows the commanded direction.

12. The vessel according to claim 11, wherein the controller is configured and programmed to control the steering angles of the two propulsion devices so that the operating point of the resultant force is positioned on a right-left direction line extending perpendicularly to the central line along a right-left direction through the rotational center when the operating device outputs a lateral movement command.

13. The vessel according to claim 11, wherein the controller is configured and programmed to control the steering angle of the first propulsion device that generates the backward thrust, so that the thrust of the first propulsion device follows a straight traveling direction; and the straight traveling direction is parallel or substantially parallel to the front-rear direction.

14. The vessel according to claim 11, wherein the controller is configured and programmed to control the thrusts of the two propulsion devices so that, when the operating device outputs a lateral movement command, the thrust of the second propulsion device that generates the forward thrust is greater than the thrust of the first propulsion device that generates the backward thrust.

15. The vessel according to claim 11, wherein the operating device is configured to output a diagonal movement command to cause a movement in a diagonal direction that obliquely intersects the central line; and the controller is configured and programmed to increase or decrease the thrust of the second propulsion device that generates the forward thrust so that the hull moves in a diagonal direction in response to receipt of a diagonal movement command generated by the operating device being moved diagonally after a lateral movement.

16. The vessel according to claim 15, wherein, the controller is configured and programmed to increase the thrust of the second propulsion device that generates the forward thrust in response to the diagonal movement command being a diagonally forward movement command, and the controller is configured and programmed to decrease the thrust of the second propulsion device that generates the forward thrust in response to the diagonal movement command being a diagonally backward movement command.

17. The vessel according to claim 16, wherein the controller is configured and programmed to control the steering angles of the two propulsion devices so that, in response to the diagonal movement command being a diagonally forward movement command, the operating point of the resultant force is positioned ahead of the rotational center and so that, in response to the diagonal movement command being a diagonally backward movement command, the operating point of the resultant force is positioned behind the rotational center.

18. The vessel according to claim 11, wherein the controller is configured and programmed to control the steering angles and the thrusts of the two propulsion devices so that a half-line drawn so as to pass through the operating point of the resultant force from the rotational center coincides with a line of action of the resultant force.

19. The vessel according to claim 11, wherein the operating device is configured to output a turning command to cause the hull to turn round; and when the operating device outputs the turning command along with the lateral movement command, controller is configured and programmed to change the steering angle of the second propulsion device that generates the forward thrust to cause the hull to turn round.

20. The vessel according to claim 19, wherein the controller is configured and programmed to control the steering angles of the two propulsion devices so that, when the operating device outputs the turning command along with the lateral movement command, the operating point of the resultant force is positioned to deviate in the front-rear direction of the vessel from the operating point of the resultant force during lateral movement.

* * * * *